US006934487B2

(12) United States Patent
De Kesel et al.

(10) Patent No.: US 6,934,487 B2
(45) Date of Patent: Aug. 23, 2005

(54) SEALING MEMBER FOR TONER CARTRIDGE

(75) Inventors: Jan De Kesel, Drogen (BE); Gino Sirejacob, Evergem (BE); Alexander Van Betsbrugge, Deinze (BE)

(73) Assignee: CF Technologies, Deinze (BE)

( * ) Notice: Subject to any disclaimer, the term of this patent is extended or adjusted under 35 U.S.C. 154(b) by 0 days.

(21) Appl. No.: 10/278,046

(22) Filed: Oct. 22, 2002

(65) Prior Publication Data

US 2003/0152399 A1 Aug. 14, 2003

Related U.S. Application Data

(63) Continuation-in-part of application No. 10/197,240, filed on Jul. 16, 2002, now Pat. No. 6,760,556, and a continuation-in-part of application No. 10/108,273, filed on Mar. 26, 2002, now Pat. No. 6,775,493, and a continuation-in-part of application No. 10/071,254, filed on Feb. 8, 2002, now Pat. No. 6,778,793.

(51) Int. Cl.[7] ..... G03G 15/08
(52) U.S. Cl. ..... 399/106; 222/DIG. 1
(58) Field of Search ..... 399/106, 105, 399/103, 102; 222/DIG. 1; 383/205, 207

(56) References Cited

U.S. PATENT DOCUMENTS

| | | | | |
|---|---|---|---|---|
| 5,027,156 A | * | 6/1991 | Kobayashi | 399/106 |
| 5,110,646 A | | 5/1992 | Prestel et al. | 428/43 |
| 5,177,540 A | * | 1/1993 | Honda et al. | 399/106 |
| 5,523,828 A | | 6/1996 | De Kesel | 399/103 |
| 5,826,140 A | | 10/1998 | Zona et al. | 399/106 |
| 5,930,559 A | | 7/1999 | De Kesel | |
| 5,974,286 A | * | 10/1999 | Ban et al. | 399/106 |
| RE36,920 E | | 10/2000 | De Kesel | 399/106 |
| 2001/0026706 A1 | | 10/2001 | Sirejacob | |

FOREIGN PATENT DOCUMENTS

| | | | | |
|---|---|---|---|---|
| EP | 0 788 033 | | 8/2001 | |
| EP | 0788033 | | 8/2001 | G03G/15/08 |
| GB | 2 286 062 | | 8/1995 | |
| JP | 01161274 | A1 | 6/1989 | |
| JP | 01310372 | A1 | 12/1989 | |
| JP | 02028673 | A1 | 1/1990 | |
| JP | 04006046 | A1 | 1/1992 | |
| JP | 2000-162857 | * | 6/2000 | |
| JP | 2002040780 | A1 | 2/2002 | |

* cited by examiner

*Primary Examiner*—Sophia S. Chen
(74) *Attorney, Agent, or Firm*—Darby & Darby

(57) ABSTRACT

Sealing film having a substantially longitudinal central strip to be torn out between a first end and a second end, whereby the central strip has a substantially constant width and a substantially longitudinal central axis, and whereby an end of the central strip adjacent to one end selected from the first end and the second end has a width which varies from the substantially constant width of the central strip to an end width lower to the substantially constant width of central strip.

112 Claims, 14 Drawing Sheets

SEALING MEMBER FOR TONER CARTRIDGE

The present application is a continuation in part of U.S. Ser. No. 10/071,254, filed on Feb. 8, 2002 now U.S. Pat. No. 6,778,793, in the name of Jan De Kesel, as well as of U.S. Ser. No. 10/108,273 filed on Mar. 26, 2002 now U.S. Pat. No. 6,775,493 in the name of Jan De Kesel and Van Betsbrugge Alexander and of U.S. Ser. No. 10/197,240 filed on Jul. 16, 2002 now U.S. Pat. No. 6,760,556 in the name of Jan De Kesel, Van Betsbrugge Alexander and Sirejacob Gino. The content of these applications is incorporated in the present specification by reference.

FIELD OF THE INVENTION

The present invention relates to a sealing member for toner cartridge, said sealing member comprising a sealing film ensuring the formation of an opening with a substantially constant width after tearing a central longitudinal portion of said sealing film.

THE PRIOR ART

Up to now many researches have been made in order to find a sealing film for sealing a toner cartridge, which is flexible and which after longitudinal tearing, is suitable for defining an opening with a substantially constant width.

Prestel et al (U.S. Pat. No. 5,110,646) discloses a sealing member not having a preferred tearing direction, which is provided with a series of adjacent perforations. Such perforations cause leakage of toner particles, whereby the use of such sealing member has not be considered as useful by the man skilled in the art.

Films having a preferred tearing linear direction are nowadays used extensively for sealing toner container. However, even with means for lowering the initial tearing force, the opening formed after tearing a central strip is reduced most of the time, some times increased, from the initial tearing end up to the terminal tearing end.

For ensuring a substantially constant width of the opening formed after tearing a central strip from the sealing film, EP-0 788 033 (Canon) has proposed to use a sealing film comprising a base layer having a tearing directionality, a guide layer having a tearing guide portion formed by a laser processing, and a laser barrier layer provided between said base layer and said guide layer. Such a film is expensive and the risk to have an undesired tearing is high as the base layer and barrier layer can induce an undesired tearing.

U.S. Pat. No. 5,523,828 (Canon) discloses a sealing film provided with a flexible tape, a first portion of which attached to the film defines the strip to be torn out, while the other portion of which acts as pulling means. The aim of the first portion of the flexible strip which extends on one surface of the sealing film (i.e. from one free end of the film up to the opposite free end of the film) is to ensure a minimum width of the strip to be torn so as to define an opening or passage for the toner with a minimum width.

Re No. 36,920 (De Kesel) discloses a seal for a toner cartridge provided with means for lowering the initial tearing force.

Applicants have searched means for reducing the end tearing force and which enables a correct initial tearing.

SUMMARY OF THE INVENTION

The invention relates to a sealing member for toner cartridge, said member comprising at least a sealing film having a substantially longitudinal portion to be torn out between a first end and a second end, said substantially longitudinal having a central portion between said first end and second end, said central portion having a substantially constant width and a substantially longitudinal central axis, whereby a portion of said substantially longitudinal portion adjacent to the first end is connected to a pulling means, and whereby at least an end portion of the substantially longitudinal portion to be torn adjacent to one end selected from the first end and the second end has a width which varies from the substantially constant width of the central portion to an end width lower to the substantially constant width of the substantially longitudinal portion, advantageously lower to 0.8 time the substantially constant width of the substantially longitudinal portion, preferably lower to 0.5 time the substantially constant width of the substantially longitudinal portion.

For example, the end width is lower than 2 mm, most preferably equal to about 0 mm.

According to an embodiment, the sealing film has two longitudinal edges and two transversal edges, in which at least one end selected from the first end and the second end of the substantially longitudinal portion to be torn is does not reach a transversal edge of the sealing film. For example, the sealing film has two longitudinal edges and two transversal edges, in which the first end and the second end of the substantially longitudinal portion to be torn do not reach a transversal edge of the sealing film.

According to a detail of an embodiment, at least one end portion of the substantially longitudinal portion to be torn adjacent to one end selected from the first end and the second end has a width which continuously varies from the substantially constant width of the central portion to an end width lower to the substantially constant width of the substantially longitudinal portion.

Advantageously, the end portion has a length of at least 1 mm, advantageously of at least 3 mm, preferably of at least 5 mm (for example 6 mm, 8 mm, 10 mm, 12 mm, 15 mm), said length being measured in the direction of the substantially longitudinal central axis of the central portion.

Preferably, the first end portion and the second end portion have a variable width which continuously varies from the substantially constant width of the central portion to an end width lower to the substantially constant width of the substantially longitudinal portion According to a specific embodiment, the second end portion has a variable width which continuously varies from the substantially constant width of the central portion to an end width lower to the substantially constant width of the substantially longitudinal portion, while the first portion is provided with a means for lowering the initial tearing force.

The sealing film is advantageously provided with means for controlling the tearing of the substantially longitudinal portion out of the film, for example a tearing control means selected from the group consisting of grooves, partial cuts, recesses, openings and combinations thereof at least at an end portion having a width which varies from the substantially constant width of the central portion to an end width lower to the substantially constant width of the substantially longitudinal portion.

According to an embodiment, a substantially continuous groove defines in the film the substantially longitudinal portion to be torn off.

According to a more specific embodiment, the central portion is defined between two substantially parallel grooves, while at least a groove defines an end portion having a width which varies from the substantially constant width of the central portion to an end width lower to the substantially constant width of the substantially longitudinal portion, whereby at least a part (advantageously a linear part) of the groove of said end portion forms an angle comprised between 5 and 85° (advantageously between 15° and 75°, such as 20, 30, 40, 50, 60°, etc.) with respect to the pulling direction.

According to another specific embodiment, the central portion is defined between two substantially parallel linear grooves, while at least a groove defines an end portion having a width which varies from the substantially constant width of the central portion to an end width lower to the substantially constant width of the substantially longitudinal portion, whereby at least a linear part of the groove of said end portion forms an angle comprised between 110° and 160° with one of the two substantially parallel grooves, whereby said linear part of the end portion is connected to one of the substantially parallel linear grooves by a curved groove.

The end portion has for example at least partly a curved shape, such as a substantially hemi circular shape.

The sealing film has advantageously a thickness comprised between 20 μm and 1 mm, such as a thickness of 50 μm, 100 μm, 150 μm, 250 μm, etc.

The sealing film is for example a film, whereby said longitudinal portion extending between a first line and a second line and to being adapted to be torn between a first end and a second end, wherein said sealing film comprises a layer with a thickness comprised between 20 μm and 1 mm and with at least one preferred substantially linear tearing direction, said layer being provided with at least:

- a first longitudinal surface element selected from the group consisting of cuts, grooves, recesses and combinations thereof and extending along the first line, and
- a second longitudinal surface element selected from the group consisting of cuts, grooves, recesses and combinations thereof and extending along the second line, whereby said longitudinal surface elements extend in a direction of at least 5° with respect to the preferred substantially linear tearing direction.

Advantageously, the substantially longitudinal portion to be torn out is associated to a pulling means having a portion intended to extend at least partly over one face of the film before the tearing of said portion, whereby at least the portion of the pulling means adjacent to the first end of the portion to be torn out has a sufficient tearing resistance for preventing a separation between the pulling means and the substantially longitudinal portion to be torn out during at least the tearing of the first end of the substantially longitudinal portion of the film to be torn out.

Preferably, at least the portion of the pulling means intended to extend at least partly over one face of the film before the tearing of the substantially longitudinal portion of the film has a sufficient tearing resistance for preventing a separation between the pulling means and the first end of the substantially longitudinal portion to be torn out during the tearing of the substantially longitudinal portion of the film to be torn out from its first end up to its second end.

Advantageously, the pulling means is made in a material having a sufficient tearing resistance for preventing a rupture of the pulling means during the tearing of the substantially longitudinal portion from its first end up to its second end.

The film and pulling means are for example made at least partly from one single flexible sheet material with a thickness of at least 40 μm, advantageously of at least 100 μm, preferably of at least 200 μm.

The sealing film is advantageously associated with a means for lowering the initial tearing force.

The sealing film is for example a film, whereby said longitudinal portion extending between a first line and a second line and to being adapted to be torn between a first end and a second end, wherein said sealing film comprises a layer with a thickness comprised between 20 μm and 1 mm and with at least one preferred substantially linear tearing direction, said layer being provided with at least:

- a first longitudinal surface element selected from the group consisting of cuts, grooves, recesses and combinations thereof and extending along the first line, and
- a second longitudinal surface element selected from the group consisting of cuts, grooves, recesses and combinations thereof and extending along the second line, whereby said longitudinal surface elements extend in a direction of at least 5° with respect to the preferred substantially linear tearing direction, in which the elements are located on a face of the film not intended to be directed towards the toner cartridge.

Preferably, the substantially longitudinal portion to be torn out is associated to a pulling means having a portion intended to extend at least partly over one face of the film before the tearing of said portion, while at least the portion of the pulling means adjacent to the first end of the portion to be torn out has a sufficient tearing resistance for preventing a separation between the pulling means and the substantially longitudinal portion to be torn out during at least the tearing of the first end of the substantially longitudinal portion of the film to be torn out.

Advantageously, at least the portion of the pulling means intended to extend at least partly over one face of the film before the tearing of the substantially longitudinal portion of the film has a sufficient tearing resistance for preventing a separation between the pulling means and the first end of the substantially longitudinal portion to be torn out during the tearing of the substantially longitudinal portion of the film to be torn out from its first end up to its second end.

According to an embodiment, the substantially longitudinal portion to be torn out is associated to a pulling means having a portion intended to extend at least partly over one face of the film before the tearing of said portion, whereby at least the portion of the pulling means is intended to be bent before the tearing of the substantially longitudinal portion, so that the pulling means extends at least partly over one face of the film before the tearing of the substantially longitudinal portion of the film. The pulling means has a sufficient tearing resistance for preventing a separation between the pulling means and the first end of the substantially longitudinal portion to be torn out during the tearing of the substantially longitudinal portion of the film to be torn out from its first end up to its second end.

According to a preferred embodiment, the pulling means is made in a material having a sufficient tearing resistance for preventing a rupture of the pulling means during the tearing of the substantially longitudinal portion from its first end up to its second end. Such a pulling means is for example a longitudinally oriented film (for example a film having for example a preferred tearing direction perpendicular to the preferred tearing direction of the sealing film), film comprising a mat of fibres, thicker flexible film, films made in a material having a high tearing resistance, film with a high stretching resistance, semi rigid supports, semi rigid plates or strips, laminated material, etc.

According to a detail of a preferred embodiment, the film and pulling means are made at least partly from one single flexible sheet material with a thickness of at least 40 μm, preferably of at least 100 μm, most preferably 125 μm or more. The film is for example a multilayered film, i.e.

comprising at least one layer having a preferred tearing direction and another layer providing tearing resistance, such a non oriented layer, a reinforced layer, etc. In this case, the grooves for defining the first and second lines extend in the thickness of the other layer(s) and partly in the thickness of the layer having a preferred tearing direction.

According to a detail, the longitudinal surface elements (grooves, recesses, etc.) are preferably associated with a means for lowering the initial tearing force.

Preferably, the elements are located on a face of the film intended to be directed towards the toner cartridge. Possibly said elements are located on a face of the film not intended to be directed towards the toner cartridge. According to a possible specific embodiment, the two opposite faces of the film are provided with one or more surface elements.

For example, the longitudinal surface elements form an angle comprised between 5 and 175° with respect to the preferred substantially linear tearing direction and extend only partially into the thickness of the layer so as not to transverse the layer. Preferably, the longitudinal surface elements form an angle between 45° and 135° with respect to the preferred substantially linear direction. Most preferably, the longitudinal surface elements form an angle of about 90° with respect to the preferred substantially linear direction.

The invention relates also to a sealing film for a toner cartridge, said film having a substantially longitudinal portion to be torn out between a first end and a second end, said longitudinal portion extending between a first line and a second line and to being adapted to be torn between a first end and a second end, wherein said sealing film comprises a layer with a thickness comprised between 20 $\mu$m and 1 mm and with at least one preferred substantially linear tearing direction, said layer being provided with at least:

- a first longitudinal surface element selected from the group consisting of cuts, grooves, recesses and combinations thereof and extending along the first line, and
- a second longitudinal surface element selected from the group consisting of cuts, grooves, recesses and combinations thereof and extending along the second line, whereby said longitudinal surface elements extend in a direction of at least 5° with respect to the preferred substantially linear tearing direction, in which the substantially longitudinal portion to be torn out is associated to a pulling means having a portion intended to be bent so that the pulling means extends at least partly over one face of the film before the tearing of said portion, and in which at least one connecting means links the substantially longitudinal portion to be torn out with the pulling means, whereby said connecting means has a sufficient tearing resistance for preventing a separation between the pulling means and the substantially longitudinal portion to be torn out during at least the tearing of the first end of the substantially longitudinal portion of the film to be torn out.

Advantageously, at least one connecting means links the substantially longitudinal portion to be torn out with the pulling means, whereby said connecting means has a sufficient tearing resistance for preventing a separation between the pulling means and the substantially longitudinal portion to be torn out during the tearing of the substantially longitudinal portion from its first end up to its second end.

For example, said connecting means is selected from the group consisting of welding means, gluing means, clipping means, and mixtures thereof.

Preferably, said connecting means is selected from the group consisting of welding lines, welding points, welding surfaces, gluing points, gluing lines, gluing surfaces, and mixtures thereof.

According to a detail of an embodiment, the pulling means is made in a material having a sufficient tearing resistance for preventing a rupture of the pulling means during the tearing of the substantially longitudinal portion from its first end up to its second end.

According to an embodiment, the connecting means is a means increasing the tearing resistance of the pulling means at least for a portion of the pulling means adjacent to the first end of the substantially longitudinal portion to be torn out.

For example, the connecting means is a means increasing the tearing resistance of the pulling means at least for a portion of the pulling means adjacent to the first end of the substantially longitudinal portion to be torn out, as well as the first end of the substantially longitudinal portion to be torn out.

For example, the connecting means increasing the tearing resistance is selected from the group consisting of flexible tapes, longitudinal welding lines, flexible layers attached to the layer with preferred substantially linear tearing direction, and mixtures thereof.

According to an embodiment, the film and pulling means are made at least partly from one single flexible sheet material.

According to a specific embodiment, the sealing film has a substantially longitudinal portion to be torn out between a first end and a second end with a variable width, said longitudinal portion extending between a first line and a second line and to being adapted to be torn between a first end and a second end, wherein said sealing film comprises a layer with a thickness comprised between 20 $\mu$m and 1 mm and with at least one preferred substantially linear tearing direction, said layer being provided with a means reducing the width of the portion adjacent to the second end of the longitudinal portion to be torn out during the tearing of said second end.

According to a detail of possible and preferred embodiment, the longitudinal surface elements are associated with a means for lowering the initial tearing force.

Advantageously, the surface elements are located on a face of the film intended to be directed towards the toner cartridge. Possibly said elements are located on a face of the film not intended to be directed towards the toner cartridge. According to a possible specific embodiment, the two opposite faces of the film are provided with one or more surface elements.

For example, the longitudinal surface elements form an angle comprised between 5 and 175°, preferably between 45° and 135°, most preferably about 90°, with respect to the preferred substantially linear tearing direction and extend only partially into the thickness of the layer so as not to transverse the layer.

According to an embodiment of the sealing film, the longitudinal portion extends between a first upper line and a second lower line, whereby when the toner cartridge is placed in a copier, laser printer, fax machine or printer, the second lower line is substantially horizontal and extends at a level lower than the level at which the first upper line extends, and the first upper line is associated to a means intended for reducing the width of the portion adjacent to the second end of the longitudinal portion to be torn out during the tearing of said second end.

The invention further relates to a sealing film for toner cartridge, said film having a substantially longitudinal portion to be torn out between a first end and a second end with a variable width, said longitudinal portion extending between a first line and a second line and to being adapted to be torn between a first end and a second end, wherein said sealing film comprises a layer with a thickness comprised between 20 μm and 1 mm and with at least one preferred substantially linear tearing direction, said layer being provided with a means intended for reducing the width of the portion adjacent to the second end of the longitudinal portion to be torn out during the tearing of said second end.

Advantageously, the longitudinal portion extends between a first upper line and a second lower line, whereby when the toner cartridge is placed in a copier, laser printer, fax machine or printer, the second lower line is substantially horizontal and extends at a level lower than the level at which the first upper line extends, while the first upper line is associated to a means intended for reducing the width of the portion adjacent to the second end of the longitudinal portion to be torn out during the tearing of said second end.

Preferably, the longitudinal surface elements (grooves, recesses, etc.) are associated with a means for lowering the initial tearing force (for example cuts).

For example, the elements are located on a face of the film intended to be directed towards the toner cartridge. Possibly said elements are located on a face of the film not intended to be directed towards the toner cartridge. According to a possible specific embodiment, the two opposite faces of the film are provided with one or more surface elements.

According to specific embodiment, the longitudinal surface elements form an angle comprised between 5 and 175°, preferably between 45° and 135°, most preferably about 90°, with respect to the preferred substantially linear tearing direction and extend only partially into the thickness of the layer so as not to transverse the layer.

According to a detail of an embodiment, at least the major portion of the first and second longitudinal surface elements are substantially perpendicular to the preferred linear tearing direction, and said first and second longitudinal surface elements extend substantially from the first end up to the second end.

The sealing member is advantageously adapted so that the portion to be torn out covers at least substantially completely the opening of the toner cartridge.

The invention relates also to a toner holder provided with one sealing film as disclosed here above.

With respect to the sealing film suitable for the invention, reference is made to U.S. Ser. No. 10/071,254, filed on Feb. 8, 2002, in the name of Jan De Kesel, as well as to U.S. Ser. No. 10/108,273 filed on Mar. 26, 2002 in the name of Jan De Kesel and Van Betsbrugge Alexander and to U.S. Ser. No. 10/197,240 filed on Jul. 16, 2002 in the name of Jan De Kesel, Van Betsbrugge Alexander and Sirejacob Gino.

Suitable sealing film is disclosed hereafter. Such a film is for example a sealing film for toner cartridge, said film having a longitudinal portion to be torn out, said longitudinal portion extending between a first line and a second line and to be torn between a first end and a second end, wherein said sealing film comprises a layer with a thickness comprised between 20 μm and 1 mm and with a preferred substantially linear tearing direction. Said layer is provided at least with a first longitudinal surface recess, such as a groove, preferably a cut, extending along the first line and a second longitudinal surface recess such as a groove, preferably a cut, extending along the second line, whereby said longitudinal surface elements extend in a direction of at least 5° with respect to the preferred substantially linear tearing directions.

The total thickness of the sealing film or at least of the portion thereof to be torn out is preferably lower to 400 μm, such as lower than 300 μm, lower than 200 μm. Examples of thickness are 40 μm, 50 μm, 75 μm, 100 μm, 120 μm, 125 μm, 150 μm, 175 μm.

The film can have a laminated structure, but has preferably a structure comprising at most two laminated layer. When the film is a laminated structure of two layers having parallel tearing directions, it is advantageous to provide the film on both faces with surface elements selected from the group consisting of cuts, grooves, recesses and combinations thereof.

A preferred substantially linear tearing direction is the direction along which a linear tear line extends due to a tearing force.

The layer provided with the longitudinal surface elements (cuts, grooves, recesses, combinations thereof) is preferably a layer which requires means for lowering the initial tearing force, such as cuts, perforations, etc.

Advantageously, said longitudinal surface cuts, grooves, recesses or combinations thereof form an angle comprised between 5 and 175° with respect to the preferred substantially linear tearing direction and extend partially into the thickness of the layer so as not to transverse the layer.

Advantageously, the longitudinal surface cuts, grooves, recesses or combinations thereof form an angle between 45° and 135° with respect to the preferred substantially linear direction.

Preferably, the longitudinal surface cuts, grooves, recesses or combinations thereof form an angle of about 90° with respect to the preferred substantially linear direction.

Advantageously, the longitudinal surface cuts, grooves, recesses or combinations thereof extend at least at a distance of more than 1 cm from the first end of the portion Preferably, the longitudinal surface cuts, grooves, recesses or combinations thereof are associated with a means for lowering the initial tearing force.

For example, the cuts, grooves, recesses or combinations thereof are located on a face of the film intended to be directed towards the toner cartridge. Possibly said elements are located on a face of the film not intended to be directed towards the toner cartridge. According to a possible specific embodiment, the two opposite faces of the film are provided with one or more surface elements.

According to a specific embodiment, the first and second longitudinal surface cuts, recesses or grooves are substantially perpendicular to the preferred linear tearing direction, while said first and second longitudinal surface cuts, grooves or recesses extend substantially from the first end up to the second end.

According to a possible embodiment, the film comprises a first series of longitudinal surface cuts, grooves or recesses extending along the first line and a second longitudinal surface cuts, grooves or recesses extending along the second line. For example, the cuts, grooves or recesses of a series are spaced from each other with a distance of less than 10 mm, advantageously of less than 2 mm, preferably of less than 1 mm.

According to a detail of a embodiment, the cuts, grooves or recesses have a maximum depth corresponding to 95% of the thickness of the layer. The maximum depth of the cuts, grooves or recesses depends from the material, its thickness, its rigidity, etc. For example for a polypropylene film (with a linear preferred tearing direction) with a thickness of 125 μm, the maximum depth can be 90% of the mean thickness, advantageously lower than 80% of said mean thickness.

According to another detail of an embodiment, at least one portion of cuts, grooves or recesses has a minimal depth corresponding to at least 10% of the thickness of the layer, preferably corresponding to at least 20% of the thickness of the layer, most preferably corresponding to at least 30% of the thickness of the layer. For material such as polypropylene with a thickness of about 125 μm, the mean depth of the grooves, recesses, etc. is comprised between 10 and 90%, advantageously between 50 and 80% of the mean thickness, for example 60%, 70%, 75%. The minimum depth depends also from the material used, its thickness, its rigidity, etc.

The cuts, grooves or recesses may have a constant or variable depth.

The film is preferably a monolayer film provided with adhesive means. The film can be a bi-directional film. The adhesive can be a contact glue, a pressure glue, a hot-melt glue, etc. The adhesive, preferably the hot-melt adhesive can be associated to heating means (which can be removed or not from the adhesive after a heating step), such as conductive means, conductive layer, electric conducting wire or layer, etc. Such adhesive (with or without heating means or removable heating means) can also be used in sealing member comprising a multilayered film.

The monolayer film has advantageously a thickness of less than 400 μm, preferably of less than 300 μm, such as 40 μm, 50 μm, 70 μm, 90 μm, 110 μm, 125 μm.

The sealing film is advantageously provided with adhesive means and with a removable protecting layer to be removed for attaching the film on the toner cartridge.

The sealing film is preferably provided with a pulling means connected to the portion to be torn. The pulling means is for example a portion of the film, or can be a band attached to the strip to be torn.

The layer is for example a layer selected from the group consisting of uniaxially oriented polyethylene film, uniaxially oriented polypropylene film, bi phase polymer film, films made of incompatible compounds, biaxially oriented polypropylene, biaxially oriented polyethylene, and mixtures thereof. The layer can be reinforced (for example with a mat of fibres, a non woven material or fabric), non reinforced, laminated or not laminated, glued or not glued to a flexible support, etc.

It has also been observed that the tearing is facilitated or more precise, when reinforcing the lateral edges of the pulling means of the sealing strip, when the pulling means is integral with the sealing member. The invention relates thus also to a sealing member provided with an integral pulling means, the lateral edges of which are reinforced.

The invention relates also to a sealing member for a toner cartridge comprising a sealing film provided with at least two surface elements selected among the group consisting of grooves, recesses, series of distant recesses, series of distant grooves, and mixtures thereof, so as to define between said two surface elements a strip to be torn out, in which at least one surface element is made at least partly by an ultrasonic treatment.

Advantageously the two surface elements are at least partly made by a ultrasonic treatment.

Preferably, the film has a melting temperature, and the ultrasonic treatment is sufficient for ensuring a heating of the material up to a temperature higher than the melting temperature of the film where said surface elements selected among the group consisting of grooves, recesses, series of distant recesses, series of distant grooves, and mixtures thereof have to be made.

The ultrasonic treatment is advantageously combined with one or more other treatments, such as compression, rolling, etc.

DESCRIPTION OF PREFERRED EMBODIMENTS

Figure 1:
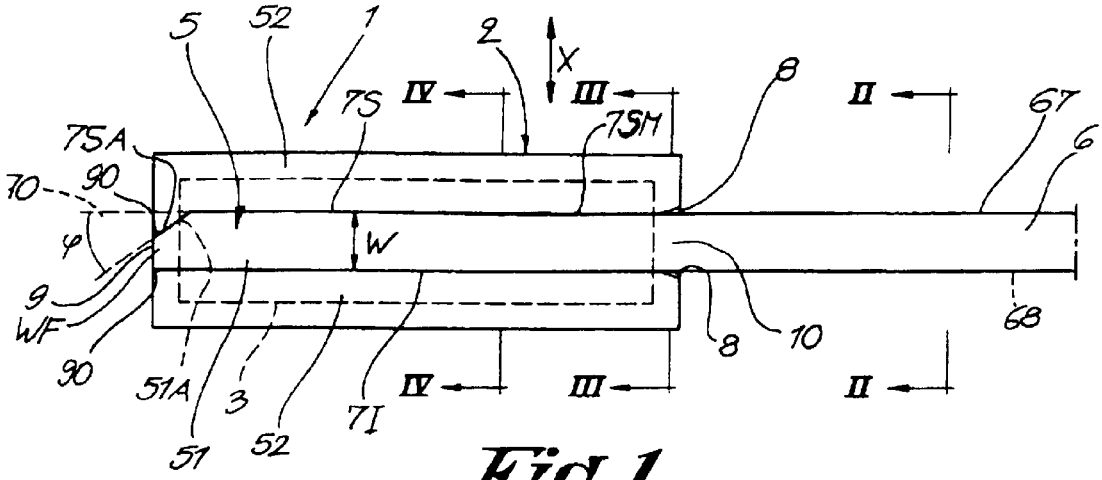
FIG. 1 is an upper view of a sealing member of the invention.

The sealing member 1 of FIG. 1 is intended to be used for sealing a toner cartridge, such as a recycled toner container of a toner cartridge. Toner cartridge provided with sealing member are disclosed for example in U.S. Pat. No. 5,826,140, the content of which is incorporated by reference.

The sealing member 1 comprises:

a sealing film 2 made for example in a mono oriented polymer (such as uniaxially oriented polymer, preferably non foamed mono oriented polymer, most preferably non foamed stretched mono oriented polypropylene), said film being a mono layer with a thickness E greater than 100 μm, such as 110, 150, 200, 250 μm, or even more an adhesive layer 3 on a face of the film (face intended to be directed towards the surface with the opening to be sealed of the toner cartridge), and a removable protection layer or film 4 (such as a silicone paper) to be removed so as to render the adhesive layer free for contacting a surface of the toner container.

The sealing film 2 comprises:

a sealing portion 5 with a central portion 51 intended to be torn out and two lateral portions 52, and a pulling portion 6 forming an extension of the central portion 51.

The other face of the film can be possibly provided with a foam layer with a central opening. In this case the central portion of the film is not bound (for example by adhesive) to said foam layer.

The sealing film is oriented and has a preferred tearing direction X. It means that in case a cut is formed in the film in the direction X, the film can be cut with an easy manual tearing. In another direction than direction X, the force required for developing a linear cut from an initial cut is not possible, except along the grooves or recesses 7I,7S formed in the films. As it can be seen the central portion or strip 51 is intended to be torn in a direction which is perpendicular to the preferred tearing direction of the film (X). The film have substantial tensile strength in the axial direction X and relatively less strength in a directional perpendicular to said direction X. The film is for example a fibrous non woven material having aligned fibres (parallel to the direction X) lightly fused together in a synthetic resinous layer. The film is preferably a non stretched film.

The grooves, cuts or recesses 7I,7S have a depth D corresponding to about 10 to 90% of the thickness E of the film (for example about 70–80% for a polypropylene film with a thickness of about 125 μm). The depth depends of many factors, such as rigidity, thickness, mechanical properties, etc.

Said grooves, cuts or recesses are preferably formed by a heating process, for example by using a heated cutting means or by pressing a heating means provided with one or more longitudinal heated lines or protuberances. Said grooves, cuts or recesses are preferably made at a temperature higher than the soft temperature of the film, most preferably at a temperature higher than a glass transition temperature of the material of the film, most preferably at a temperature higher than the melting temperature of at least one polymer material present in the film or at a temperature higher than the melting temperature of the film. For example, when the film is made of a blend of two incompatible or substantially incompatible polymers, the heating step is carried out at a temperature sufficient for melting one polymer, while not melting the other. When the film consists of a series of linear wires or fibres made in a first composition or polymer, said series of wires or fibres being connected or laminated with a polymer layer, said laminated polymer layer has advantageously a softening temperature higher than the softening temperature of the first polymer, preferably a melting temperature higher than the melting temperature of the melting temperature of the first polymer or polymer composition. The grooves or recesses or cuts are for example formed by means of a linear welding head, so as to exert a pressure on the film during the fusing of at least a portion of the film, preferably the fusing of at least a portion of the longitudinal polymer fibres of the film at the place of the groove or recesses or cuts 7I,7S. The welding operation, when used is advantageously an ultrasonic welding. A laser can possibly be used for making the groove, however the risk to perforated the film is too high, when the thickness is lower than 300 μm. Now, it is preferred to have thickness of less than 300 μm, in order to have sufficient flexibility, so as to bent correctly the pulling means and the strip during its tearing.

The sealing portion 5 is provided with two cuts 8 at the end of the central portion 51 adjacent to the pulling means or strip 6, said cuts forming a means for lowering the initial tearing force required for tearing the central portion 51. Depending of the used material, means for lowering the initial tearing force or for initiating the tearing are or not required for enabling a manual tearing of the strip 51. Preferably, in order to avoid accidental tearing, the film is made in a material requiring means for lowering the initial tearing force or for initiating the tearing (8).

When the sealing member 1 is attached to a toner cartridge placed in fax machine, a printer, a laser printer, a copier, etc., the lower cut or groove 8I is substantially horizontal and extend at a level lower than the level at which the upper cut or groove 8S extends.

The film 2 is provided with a means for lowering the width W of the opening formed after tearing the central portion 51 near its free end 9. For lowering said width, the upper groove 7S has an inclined portion 7SA, portion extending in a zone of the film defined between the lower cut or groove 7I and a line 70 (dashed lines) prolonging the major portion 7SM of the upper line 7S. The angle φ (between the inclined portion 7SA and the prolonging line 70) is for example comprised between 10° and 80°, advantageously between 20° and 70°, preferably between 30° and 60°, such as about 45°. The ratio width WF at the end 9 of the strip 51/maximum width W of the strip 51 is for example comprised between 0.1 and 0.7, advantageously between 0.15 and 0.5, preferably between 0.2 and 0.4. The central portion of the film 2 is torn out of the film in the direction TD.

In FIG. 1, the film is provides with longitudinal cuts 7I,7S extending partially in the thickness of the film (so as to avoid the perforation of the film), said longitudinal surface cuts 7I,7S extending from the means for lowering the initial tearing force (8) up to the end 9 of the strip 51 opposed to the end 10 of the strip 51 adjacent to the pulling means 6.

Figure 2:
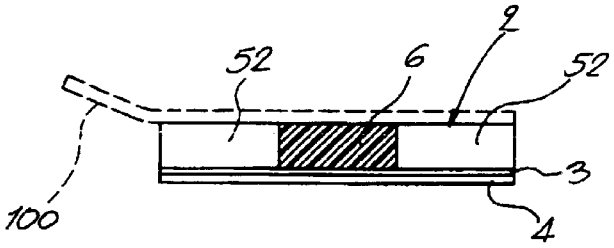
FIGS. 2 to 4 are cross section views along the line II—II, III—III and IV—IV respectively.
Figure 3:
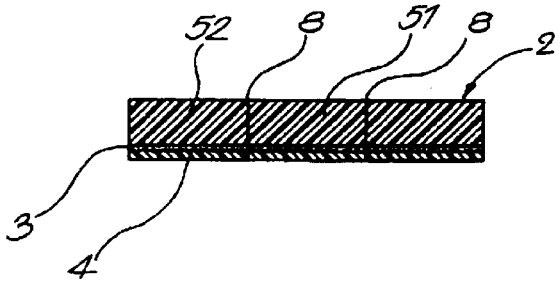
Figure 4:
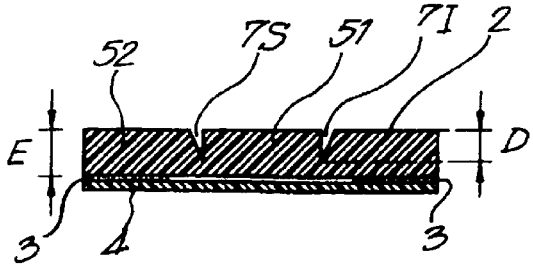

The sealing member is advantageously associated with one or more substantially rigid supports (100 shown schematically in dashed lines in FIG. 2) or elements suitable for increasing the rigidity of at least a portion of the sealing member. Said support(s) or element(s) can be removed after placement of the sealing member on the toner container. Such a substantially rigid support is disclosed in Re 36,920, the scope of which is incorporated herewith by reference.

As the film 2 is pressed between a face of the toner cartridge and a face of a support bearing the magnetic roller, the lower groove 7I and/or the upper groove 7S can be provided with cuts 90 extending through the thickness of the film so as to reduce the final tearing force.

The central strip 51 can be provided with code or coding area 51A (such as a colour line, colour zone, such as a green line, green points, etc) adjacent to the end 9 of the central strip 51. When the central strip is removed (torn out), the user can easily determined whether the strip has been sufficiently been torn out by controlling whether at least part of the coding system 51A has been torn out. If the central strip 51 is not properly torn out, the coding system or colour 51A is not present on the torn strip, whereby the user knows that the formed opening in the seal of the toner cartridge is not correct for making correct printing or copying.

Figure 5:
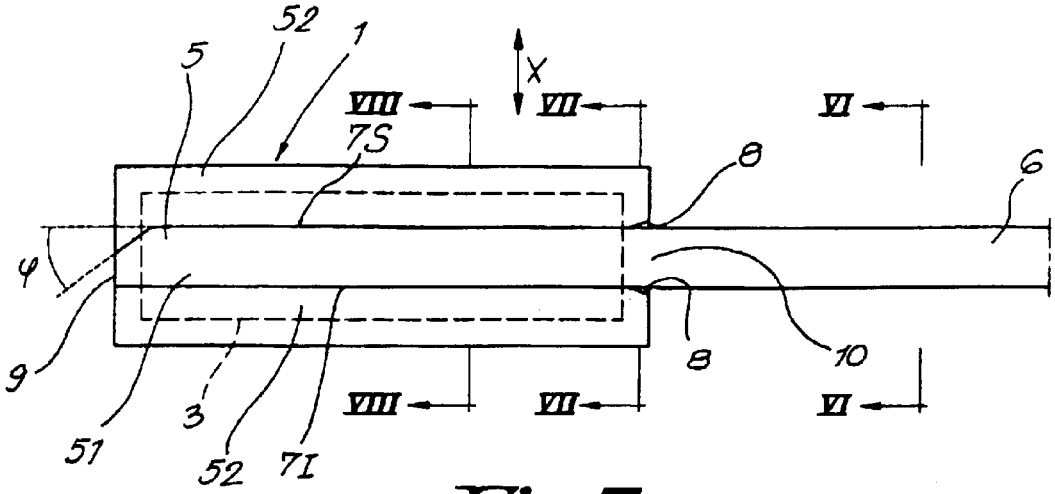
FIG. 5 is an upper view of another embodiment of the invention.
Figure 6:
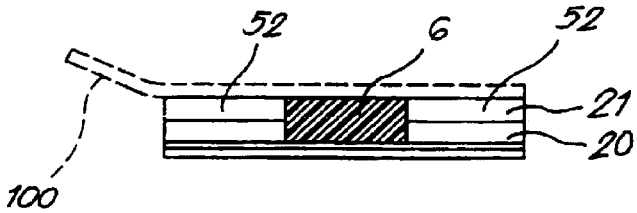
FIGS. 6 to 8 are cross section views along the line VI—VI, VII—VII and VIII—VIII respectively.
Figure 7:
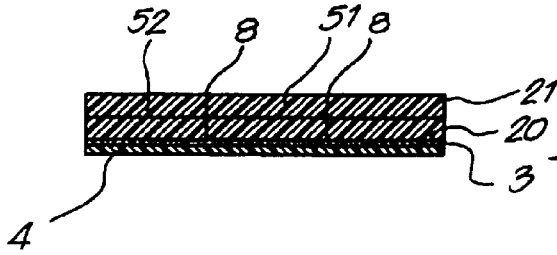
Figure 8:
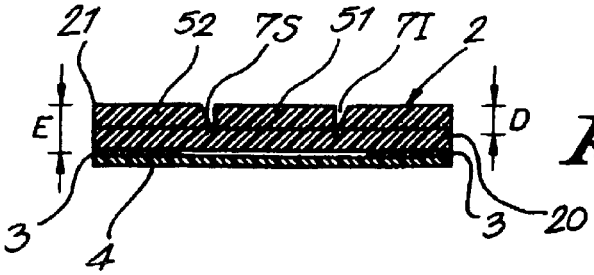

In the embodiment of FIG. 5, the sealing member is similar to that of FIG. 1, except that the sealing member is made in a two layered material, a base layer 20 with a preferred tearing direction and a covering layer 21 increasing the mechanical properties of the base layer in a direction inclined with respect to the preferred tearing direction of the base layer. Two substantially parallel grooves 7I,7S are formed in the film 2, said grooves 7I,7S having a depth sufficient for extending completely through the thickness of the covering layer and partly through the base layer 20. The covering layer is for example a fibre containing layer, a fibre mat layer, a web, a paper web, an anti adhesion layer, an anti friction layer, a layer having a preferred tearing direction perpendicular to the tearing direction of the base layer 20.

In this embodiment, the film is not provided with an inclined portion of upper groove 7S.

It has to be noted that the covering layer can possibly be a layer obtained by a treatment, a local treatment, for example of the strip 51 and the pulling means 6, for increasing the cohesion of the film or a portion thereof and/or for increasing the tearing resistance of said part in a direction parallel to the preferred tearing direction of the film before the treatment. Such treatment is for example a heat treatment, a treatment ensuring a partial fusion of the strip 51, such as an ultrasonic heating treatment ensuring the melting of the strip 51 or successive portions of said strip.

For example, the grooves 7I,7S can also be formed in the film by means of two cutting elements (such as flanges) attached to a bearer, such as a roller, said bearer or roller being heated before application of the roller on a face of the film so as to form two parallel grooves 7I,7S. Due to the heating of the bearer or roller, the face of the central strip 51 in contact with the bearer or roller is partly fused, whereby increasing the tearing resistance of the central strip in a direction parallel to the preferred tearing direction. Said heat treatment is preferably also made at least partly for the pulling means 6.

The bearer is for example provided or associated with a heating element or heater, preferably an electrical heating element.

The bearer or roller is for example heated at a temperature higher than the softening temperature of the material of the film, advantageously between the softening point and a temperature at most 50° C. higher than the fusing temperature. Most preferably, the heat treatment is made at a temperature of about the fusing temperature, for example just below the fusing temperature.

The correct movement of the bearer with respect to the film can be ensured by one or more guiding means, such rail(s), etc. In this case, the bearer is advantageously provided with carrying means, such as outer rods guided by the guiding means or rails.

Figure 25:
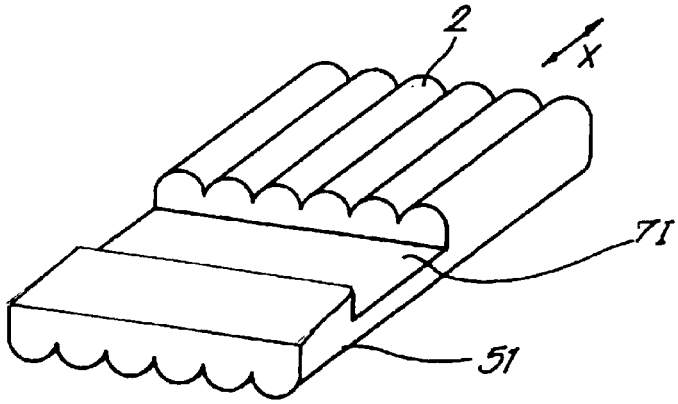
FIG. 25 is a schematic view showing the effect of the heat treatment on a portion of the sealing film (on enlarged scale and in perspective)

FIG. 25 shows on an enlarged scale the influence of the heat treatment on the face intended to be directed towards the toner holder. The strip 51 is heat treated whereby the strip portion 51 can no more be considered as having the preferred tearing direction X.

Figure 9:
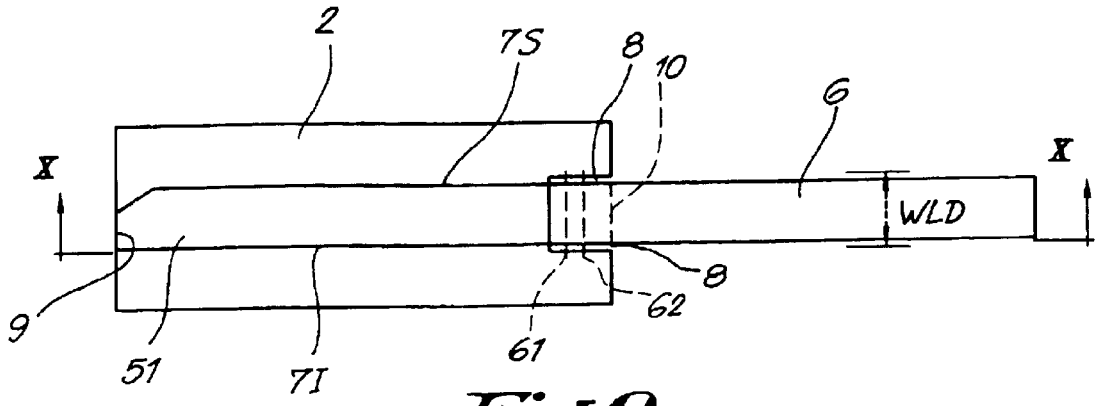
FIG. 9 is an upper view of still another embodiment.
Figure 10:
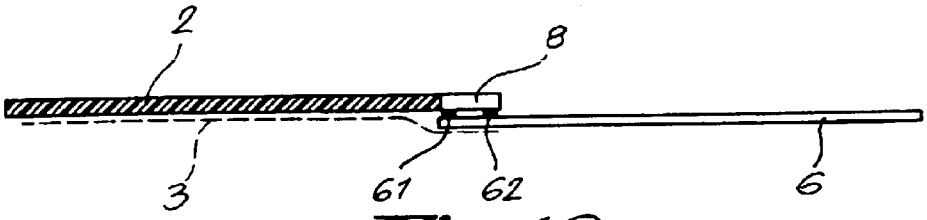
FIG. 10 is a cross section view along the line X—X.

FIG. 9 shows an embodiment of a sealing film 2 similar to the film 2 of FIG. 1. The central portion 51 of the film 2 (near its end 10) is attached to a pulling strip 6. The pulling strip is connected by one or more welding, such as two parallel welding lines 61,62 distant from each other. The welding lines 61, 62 have advantageously a width WLD greater than the width of the strip 51 and greater than the width of the pulling means 6.

The cuts 8 for lowering the initial tearing force have a length sufficient for extending through the welding lines 61,62. The cuts 8 are formed after the welding lines 61,62 and after placement of the adhesive means 3 for attaching the seal film on a toner holder.

Figure 11:
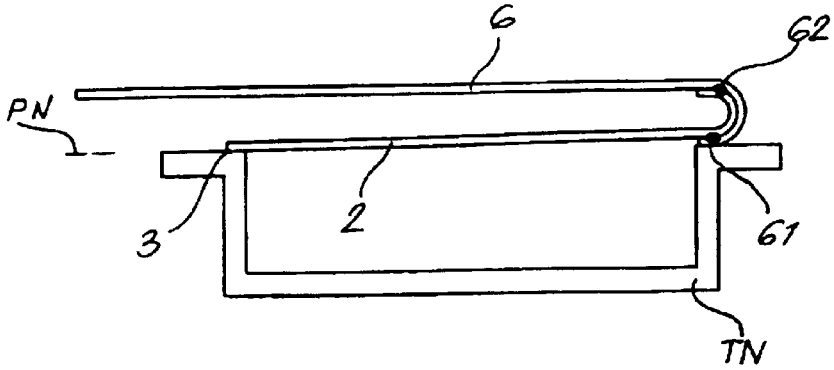
FIG. 11 is a view similar to the view of FIG. 10, with the pulling means in a bent position.

In this embodiment, the welding of the end of the pulling means 6 is made on a face of the film (near the end 10) intended to be directed towards the toner holder TN. (see FIG. 11) As it can be seen the portion of the pulling means adjacent to the end 10 is bent so that the pulling means extends over a face of the sealing film 2. The bending is advantageously such that in sealed position, one welding line 61 is in contact with the toner holder TN, while the other welding line 62 extends above the plane PN of the sealing film.

The use of welding lines distant from each other is advantageous as it facilitates the bending of the strip end 10.

The welding can be made by any welding processes, such as heat welding, wave welding, IR welding, ultra sound welding, etc.

Welding is preferred. However, it is obvious that instead of welding, the pulling means van be attached to the central strip 51 by other means such hot melt means, glue, adhesive, self adhesive, curing means, etc.

Figure 12:
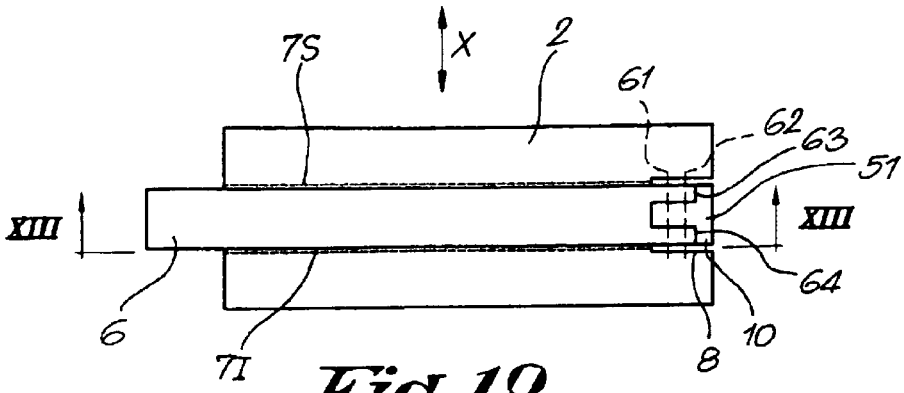
FIG. 12 is an upper view of another sealing member of the invention.
Figure 13:
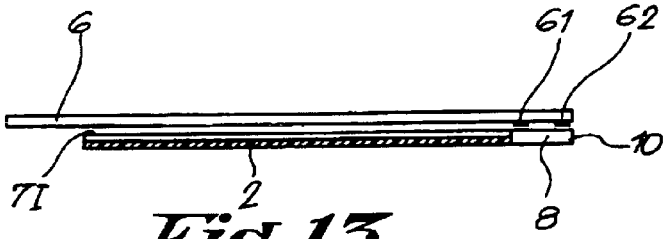
FIG. 13 is a cross section view of FIG. 12 along the line XIII—XIII.

FIG. 12 is a view of an embodiment similar to the embodiment of FIG. 9, except that the pulling means 6 is attached on the face of the film 2 not intended to be directed towards the toner holder.

The pulling strip 6 is welded to the end 10 of the central portion 51 by one welding line 61 (more welding lines are possible, if required). The strip 6 has a welded end provided with two separated legs 63,64 which are welded to the portion 51. Cuts 8 have a sufficient length so as to extend through the welding line 61.

As the pulling means of this embodiment has not to be bent, it is possible to use more rigid pulling means, such as semi rigid pulling means, etc. If required, however, the pulling means can be a flexible strip.

Figure 14:
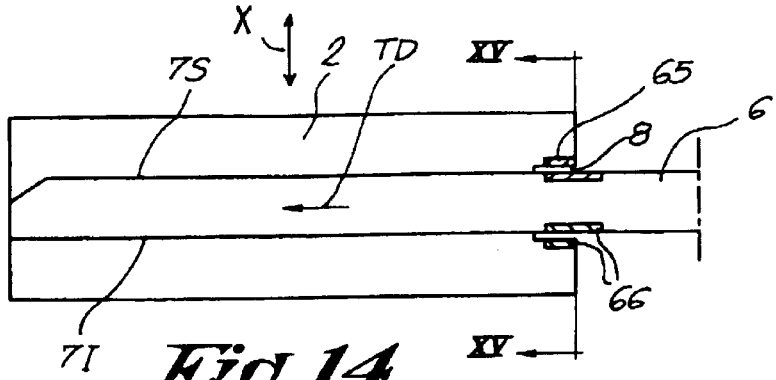
FIG. 14 is a view similar to FIG. 1.
Figure 15:
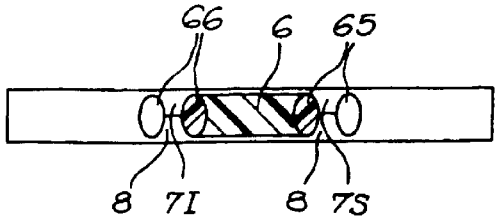
FIG. 15 is a cross section view of FIG. 15 along the line XV—XV.

FIG. 14 is a view of an embodiment similar to that shown in FIG. 1, except that, in the sealed position of the film (before its open tearing), the portion of the pulling means which is bent and the portion of the central strip 51 near the end 10 are provided with means for increasing the tearing resistance in a direction parallel to the preferred tearing direction X. Such means are for example welding lines 65,66 perpendicular to the direction X. The cuts 8 extend within the welding lines 65,66 perpendicular to the direction X. The welding lines 65,66 form a reinforcement of the pulling means 6 near the end 10, as well as at the end 10 of the central strip 51 to be torn out.

Figure 16:
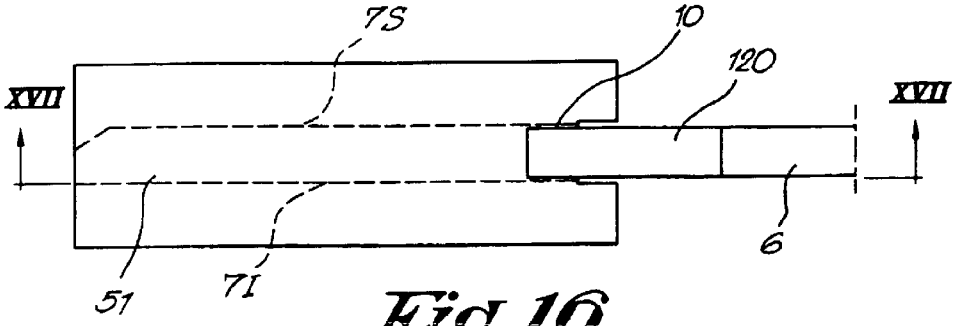
FIG. 16 is an upper view of still another embodiment of the invention.
Figure 17:
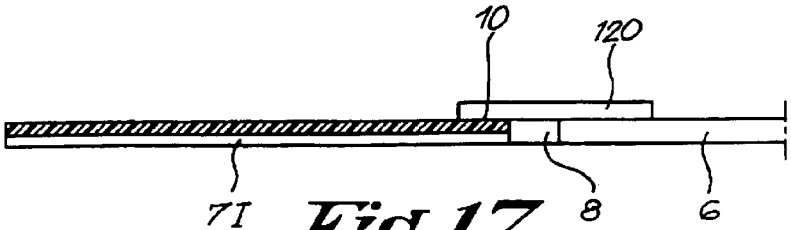
FIGS. 17 and 18 are longitudinal cross section views of FIG. 16 along the line XVII—XVII and in bending position.

FIG. 16 is a view of an embodiment similar to the embodiment of FIG. 1, except that a tape strip 120 is applied on the end portion 10 of the central portion 51 and on the part of the pulling means 6 adjacent to the end 10. Said tape strip 120 forms a reinforcement at the level of the bending portion of the pulling means 6, before the open tearing operation. (see FIG. 18). The tape strip extends on the face not intended to be directed towards the toner holder TN, the grooves 7I,7S being located on the other face.

Figure 18:
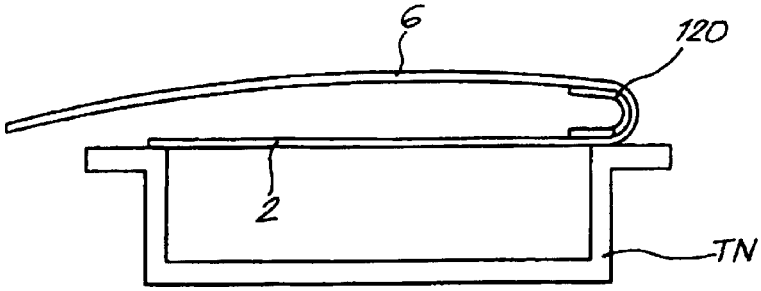
Figure 19:
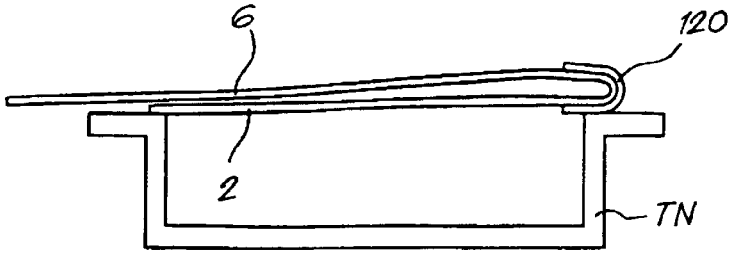
FIG. 19 is a view similar to FIG. 18 of a further embodiment.

FIG. 19 is a view of an embodiment similar to that shown in FIG. 18, except that the tape strip 120 is at least partly located along the face intended to be directed towards the toner holder TN.

Figure 20:
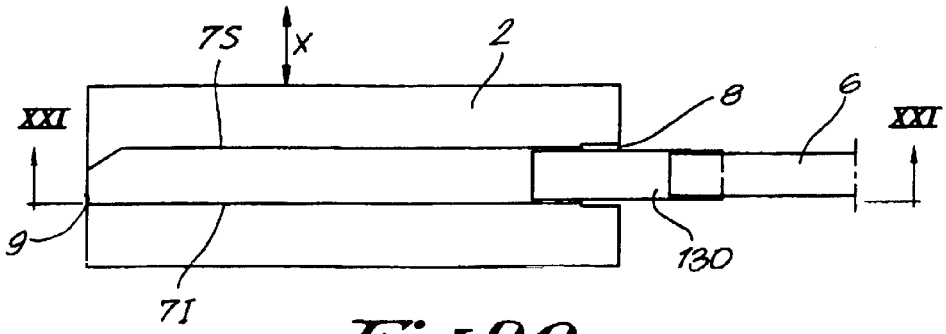
FIG. 20 is an upper view of still a further embodiment.
Figure 21:
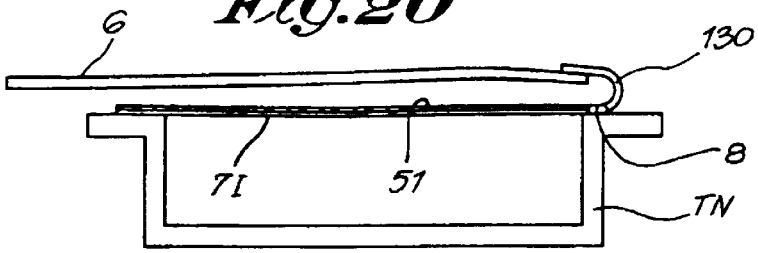
FIG. 21 is a lateral view of the sealing film of FIG. 20 with the pulling means extending along a face of the film.
Figure 22:
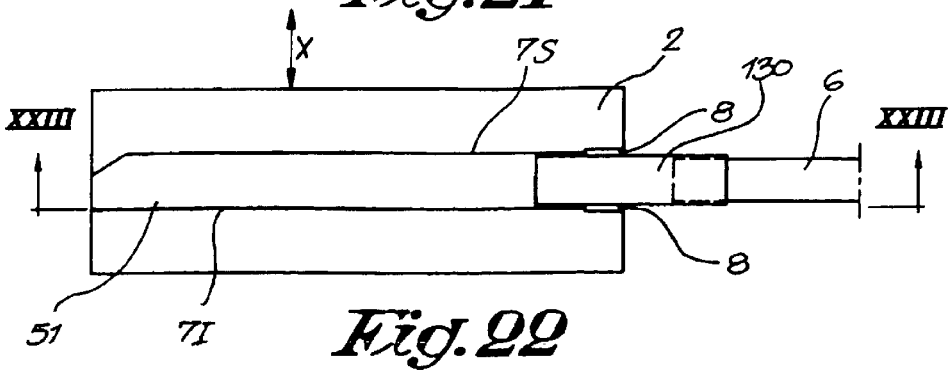
FIGS. 22 and 23 are view similar to FIGS. 20 and 21.
Figure 23:
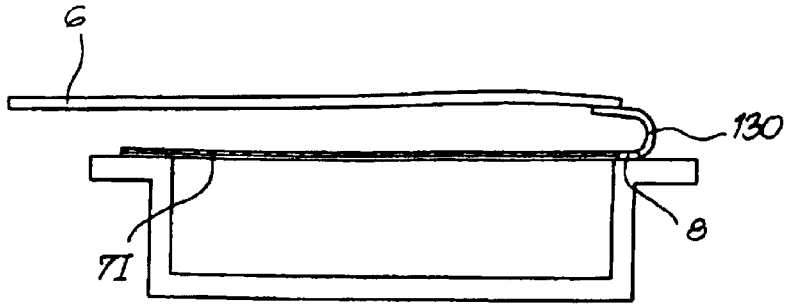

In the embodiments of FIGS. 20 and 22, the sealing film 2 similar to that shown in FIG. 1, is provided with an protrusion part 130 of the central strip 51. Said protrusion is attached to the pulling means 6 with a welding, by an adhesive, etc.

Figure 24:
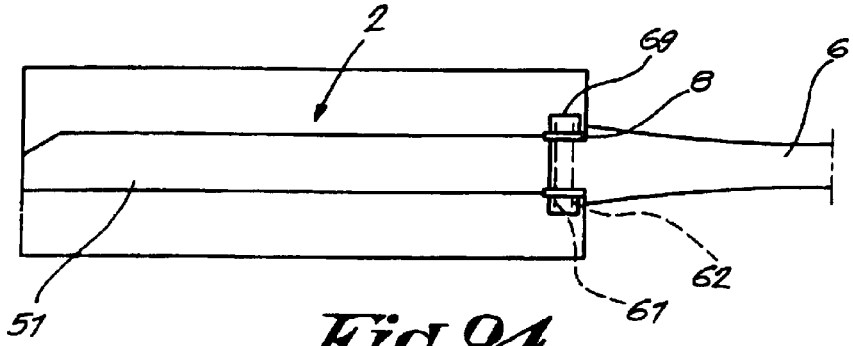
FIG. 24 is a schematic view of a further embodiment similar to the embodiment of FIG. 1.

In the embodiment of FIG. 24, which is similar to the embodiment of FIG. 9, the pulling means 6 has a portion 69 with a larger width, said portion being welded (for example by ultrasonic welding) to the film 2 (welding lines 61, 62). The cuts 8 extends through the portion 69.

Figure 26:
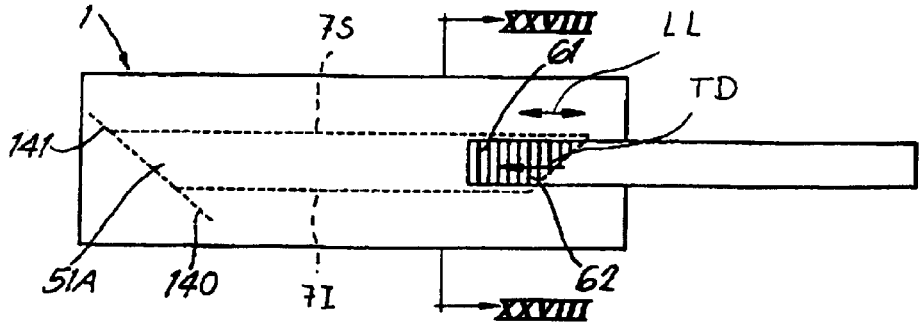
FIG. 26 is an upper view of still another embodiment of a sealing film of the invention.
Figure 27:
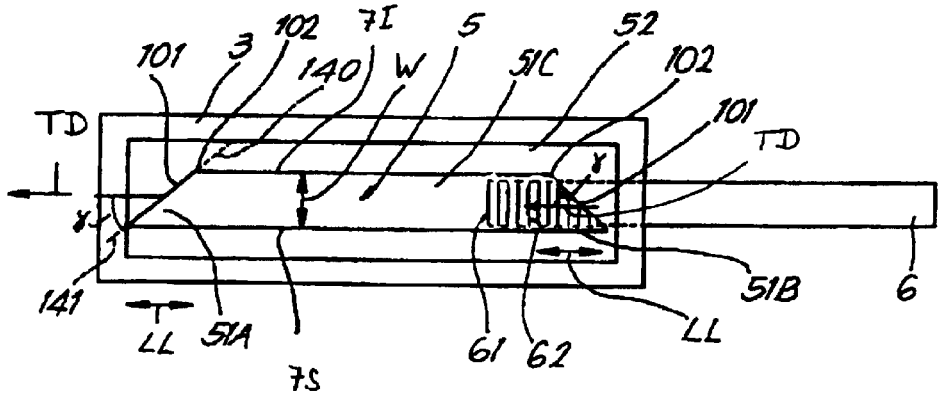
FIG. 27 is a back view of the sealing film of FIG. 26.
Figure 28:
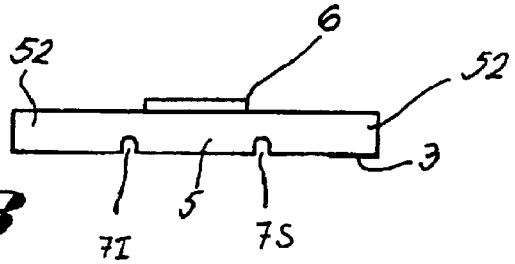
FIG. 28 is a cross section view along the lines XXVIII—XXVIII.

In the embodiment of FIG. 26, the sealing film 1 has a central longitudinal portion 5 adapted to be torn out and an outer portion 52 adapted for remaining attached to the toner container during the tearing operation. Said central longitudinal portion 51 is defined by the two parallel grooves 7I,7S (parallel to the tearing direction or the pulling direction TD), two inclined grooves 101, 102 forming an angle $\gamma$ of about 45° with respect to the pulling direct TD (angle measured in the tearing direction), and two curved portions 102 for connecting a linear groove 100 and a linear inclined groove 101.

The sealing film is provided along its edges (on the portion 52 of the film) with a glue layer for attaching the sealing film on the toner cartridge.

The central portion 5 is attached at its initial end 51B to a pulling means or strip 6. Said pulling strip 6 is attached to the central portion 5 by means of welding lines 61,62 (perpendicular to the tearing direction TD). Welding lines 61,62 extend from the top of the end portion 51B up to the central part 51C of the central portion 5 (part extending between the parallel grooves 7I,7S part having a substantially constant width W. In the end portion 51A, the width is reduced from the width W up to 0, while for the end portion 51B, the width is increased from 0 up to W.

The end portions 51A,51B extend on a length LL comprised between 0.5 cm and 1.5 cm.

The grooves are formed on the face of the film intended to be directed towards the toner cartridge.

The inclined groove 101 defining an edge of the end portion 51A can be provided with extensions 140,141 so that in case the tearing is not correctly operated along the linear grooves 7I,7S, the tearing of the longitudinal portion can be torn out.

Figure 29:
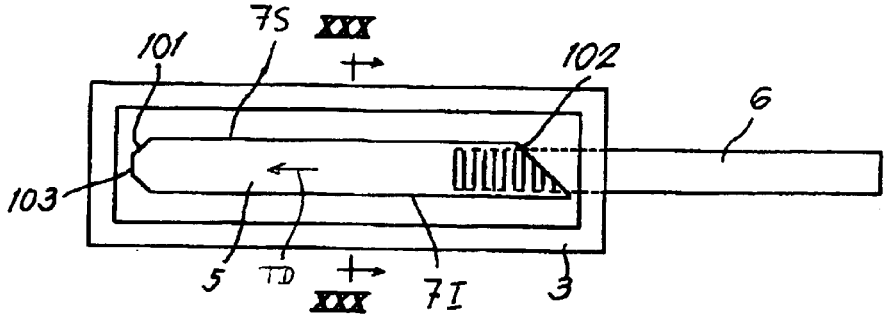
FIG. 29 is a view of anther embodiment similar to FIG. 27.
Figure 30:
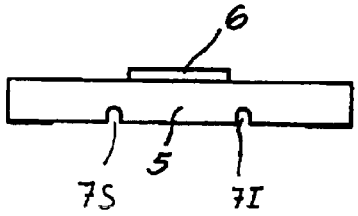
FIG. 30 is a cross section view along the line XXX—XXX of the film of FIG. 29.

The embodiment of FIG. 29 is similar to the embodiment of FIG. 26, except that the end portion 51A has two linear inclined grooves 101 and an end groove 103 perpendicular to the tearing direction TD.

Figure 31:
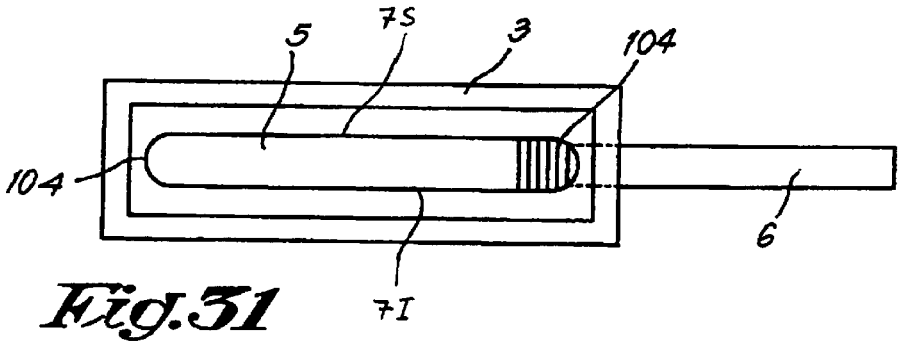
FIG. 31 is a view similar to the view of FIG. 27 but of a further embodiment.

The embodiment of FIG. 31 is similar to the embodiment of FIG. 26, except that the end portions 51A,51B have a hemi circular shape (groove 104 substantially hemi circular).

Figure 34:
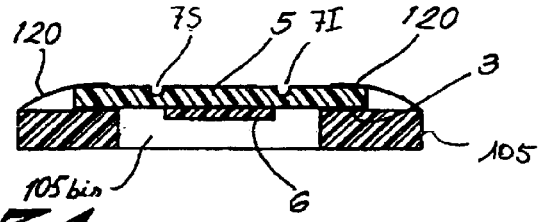
Figure 35:
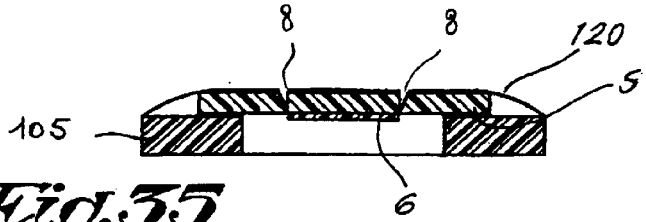
FIG. 35 is a cross section view along the line XXXV—XXXV of FIG. 32.

The embodiment of FIG. 34 is similar to the embodiment of FIG. 26, except that only the end portion 51A has a reduced width (groove 101). The initial torn portion or end 51B is provided with two cuts 8 for reducing the initial tearing force. The sealing film 1 is attached to a slotted foam insert 105 (slot 105*bis*) having a shape greater than the shape of the film. The foamed insert 105 is provided with a glue layer 102 for attaching the insert on the toner container. The pulling means 6 is bend and introduced in the slot 105*bis*, i.e. extends between the film and the foam insert. When tearing the longitudinal portion 5 of the film, said longitudinal portion 5 contacts the foam insert, the latter acting then as cleaning elements. The foam insert 105 is provided with a glue layer 120 for attaching the insert on a toner cartridge.

Figure 36:
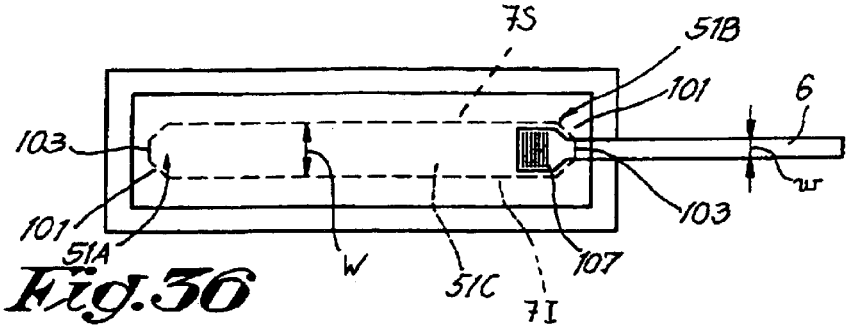
FIG. 36 is a view similar to FIG. 26 of still another embodiment.

In the embodiment of FIG. 36, the embodiment is similar to the embodiment of FIG. 29, except that the end portions 51A and 51B are defined by two inclined grooves and by an end groove 103. The pulling means 6 has a width w lower than the width W of the central portion 51C (between the grooves 7I,7S). The pulling means 6 has a larger end portion 107 attached to the end portion 51B by means of welding lines 61. The end portion 107 of the pulling means 6 has a shape corresponding to the shape of the end portion 51B.

Figure 37:
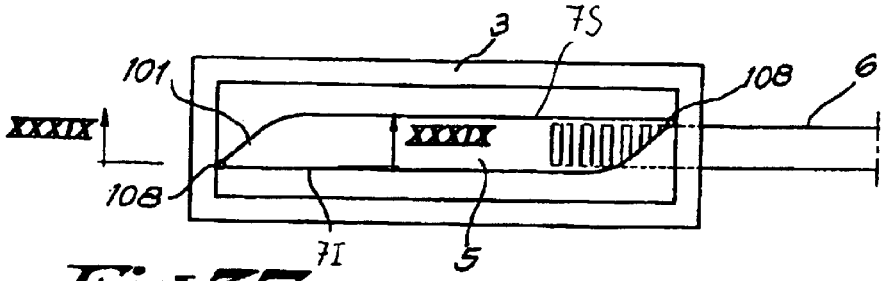
FIG. 37 is a view similar to that of FIG. 27, but for a specific embodiment.

The embodiment of FIG. 37 is similar to the embodiment of FIG. 26, except that the top 108 of the end portions 51A,51B is a recess (such as a circular recess) making a connection between the longitudinal groove 7I,7S and the inclined groove 101.

Figure 38:
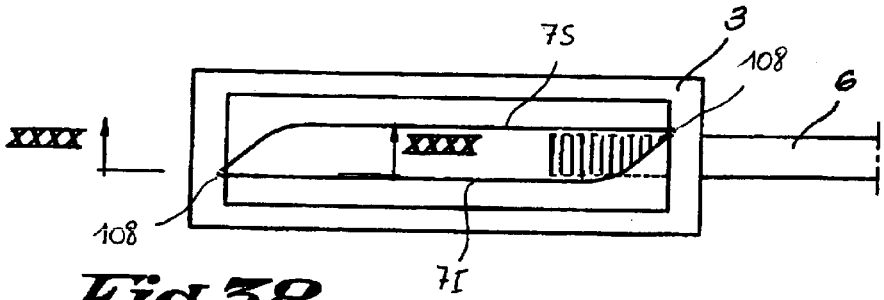
FIG. 38 is a view similar to FIG. 37, but for an amended embodiment.
Figure 40:
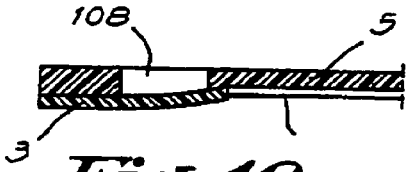
FIG. 40 is a cross section view along the line XXXX—XXXX of the embodiment of FIG. 38.
Figure 39:
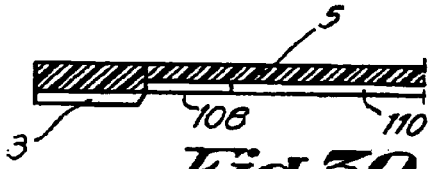
FIG. 39 is a cross section view along the line XXXIX—XXXIX of the embodiment of FIG. 37.

In the embodiment of FIG. 38, similar to the embodiment of FIG. 37, the top 108 of the end portions 51A,51B is an opening (circular opening) portions 101 making a connection between the longitudinal groove 7I,7S and the inclined groove 101.

The film is provided with a glue layer 3, said glue layer closing an end of the opening 108.

Figure 32:
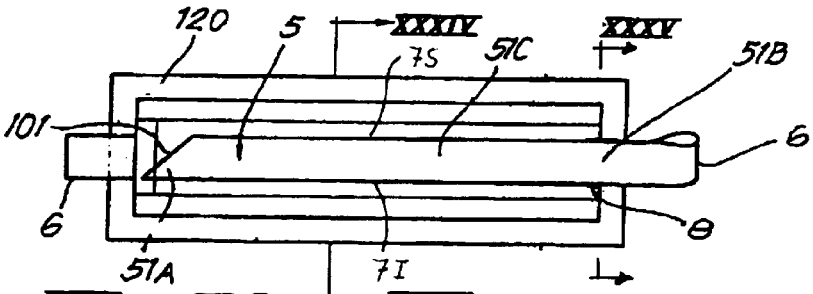
FIGS. 32 to 34 are view similar to FIGS. 26 to 28 of a further embodiment.
Figure 33:
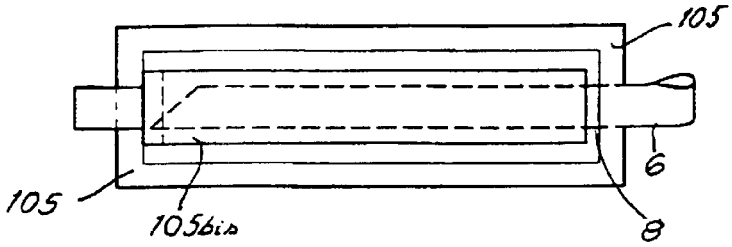
Figure 41:
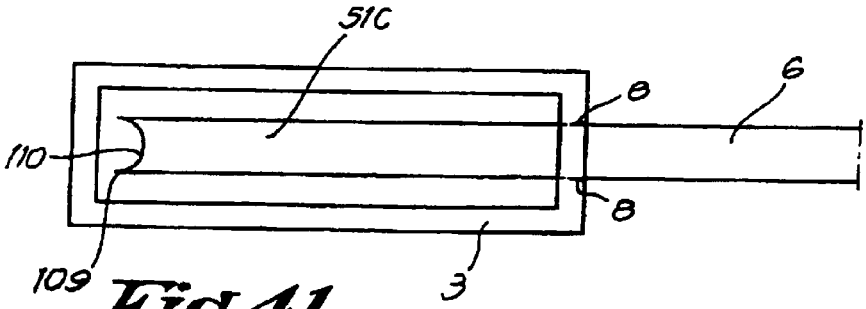
FIG. 41 is a further view of a further embodiment of a sealing film of the invention.

The embodiment of FIG. 41 is a film similar to the film used in the embodiment of FIG. 32, except that the end portion 51A has two tips 109 with a hemi circular groove 110 directed towards the central part 51C.

The cuts 8 extend also partly in the glue layer 3.

Figure 42:
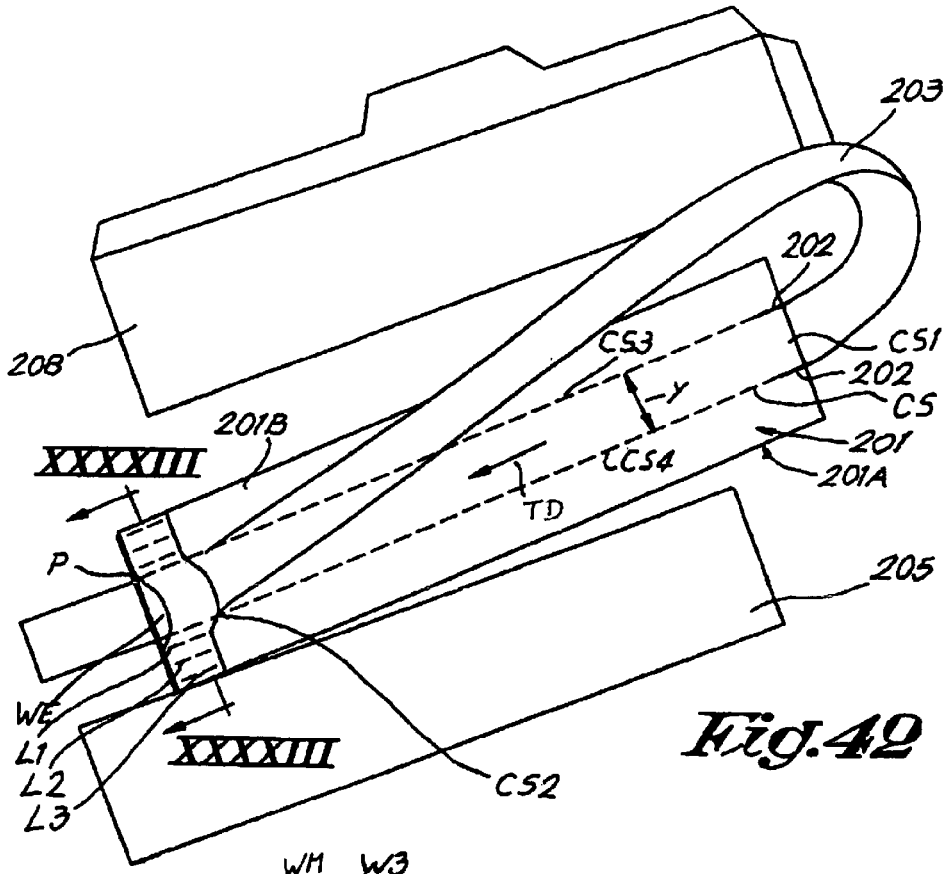
FIG. 42 is an exploded perspective view of a sealing member of the invention provided with cleaning means.
Figure 43:
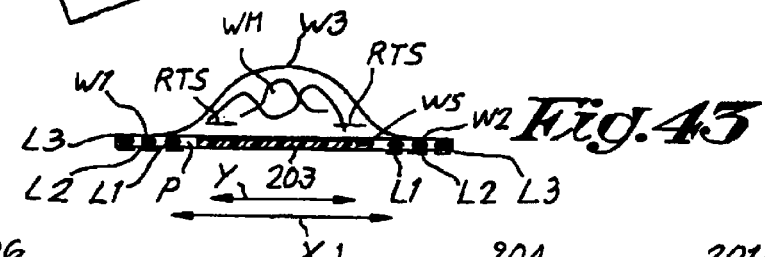
FIG. 43 is a cross section view along the lines XXXXIII—XXXXIII of the sealing member of FIG. 42.
Figure 44:
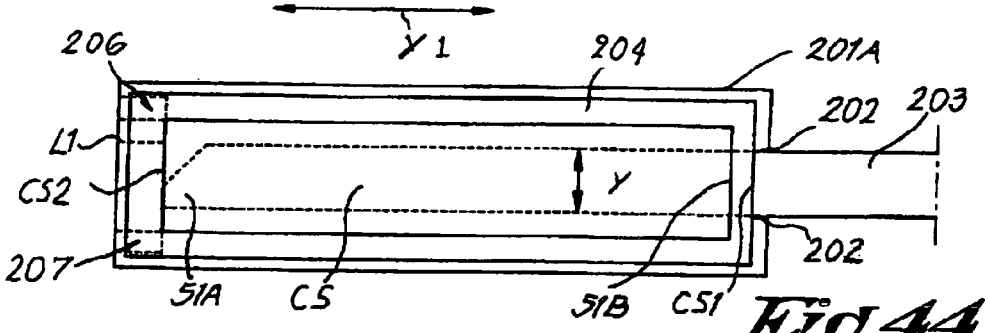
FIG. 44 is a view of the first face of the sealing film of FIG. 42.

The sealing member of FIG. 42 is intended for sealing an opening O of a surface S of a toner container TN (see FIG. 45) for laser printers, copy machines and fax machines, for example of a toner cartridge comprising a support for a magnetic roller or drum. The sealing member of FIG. 42 comprises:

- a sealing film 201 with a first face 201A intended to be directed towards the surface S for sealing the opening O of the toner container TN and a second face 201B opposite to said first face 201A, said film 201 comprising a central strip CS intended to be torn off (tearing direction TD), said central strip CS extending from a first end CS1 provided with cuts 202 for reducing the initial tearing force up to a second end CS2,
- a wiping or cleaning element WE for wiping the portion of the first face 201A of the sealing film corresponding to the central strip CS when contacting the torn central strip CS with the wiping element WE during a tearing operation,
- a pulling member 203 bound to the first end CS1 of the central strip CS, said pulling member 203 being intended to extend before the tearing off of the central strip CS at least partly above the second face 201B of the sealing film, as well partly between the wiping element WE and the film 201.

The wiping element WE is for example made of a compressible, the wiping element comprising a first lateral portion W1 in compressed state and which is welded (heat, ultrasound, etc.) to the film 201, a second lateral portion W2 in compressed state and which is welded (heat, ultrasound, etc.) to the film 1, and a third portion W3 located between the first and second portions W1,W2. The first and second portions W1,W2 are welded to the film by means of three substantially parallel welding lines L1,L2,L3. The welding lines L1 are substantially parallel to the longitudinal direction LD of the central strip CS, which corresponds also to the pulling direction of the pulling means 203. Between the welding lines L1, a passage P is defined for the pulling means 203 and for the central strip CS after its tearing off. Said passage P has a width Y1 greater than the width Y of the pulling means 203 and of the central strip CS, but lower than 1.2 times said width Y. The width Y of the central strip is defined between the two substantially parallel tearing lines CS3,CS4, which can be defined by weakening zones or grooves.

It is obvious that instead of three welding lines, it would be possible to use welding zones, welding points, a greater number of welding lines (for example 4,5,6 or more parallel welding lines), crossing welding lines, welding lines with different widths, etc.

The third portion W3 of the wiping element WE has a face WS intended to contact the face 201A of the torn central strip CS during its tearing (face in contact with toner particles). The third portion W3 is less compressed in the middle WM than in the portion adjacent to the welding L1. For example, at the welding L1, the thickness is at least 20% lower than thickness of the middle portion of the wiping element WE. In a specific embodiment, the thickness of the middle portion of the wiping element WE is at least 0.5 mm, advantageously at least 1 mm, for example 1 to 3 mm thicker than the welded portion. In the embodiment of FIG. 42, the thickness of the wiping element at the welding L1 is less than 0.5 mm, such as comprised between 0.1 and 0.4 mm, while the thickness of the middle portion is greater than 1 mm (for example comprised between 1.5 and 3 mm). A variation of compression state of the portion W3 is created between the welding lines L1, whereby relative transverse strength RTS are created between the film and the wiping portion W3. This relative transverse strength RTS is appropriate for exerting some force tending to move or apply the middle portion of the wiping portion W3 towards the film 201, when the film is sealing the opening of the surface of the toner container. The welding lines L1 forms guiding means for the pulling means 203 and for the torn central strip CS. The guiding effect is even further improved due to the higher compression at the portions of the wiping element WE adjacent to the welding lines L1, whereby ensuring a higher wearing of the longitudinal edges of the pulling means 203 and of the torn central strip and whereby ensuring a better cleaning of the edge portion of the torn central strip CS, which are often the most difficult to be cleaned correctly.

Furthermore, the higher compression state of the wiping element adjacent to the welding lines L1 can also act as means for regulating or controlling the speed of the tearing operation, so as to ensure a sufficient contact between the wiping or cleaning element WE and the face 201A of the central strip.

Finally, another advantages of the transverse strength or tension is that after the full tearing of the central strip CS from the film 1, a force is tending to apply the face WS towards the film 201 and/or towards the surface of the container, in case the central strip has a portion extending under the wiping element. Such a force is advantageous so as to avoid that possible trapped toner particles could be released after the tearing of the central strip. Such a risk can also be prevented or avoided by using wiping element having absorbing properties or properties for attracting or attaching particles on or in the wiping element.

When using other materials for the wiping or cleaning element, such as fibrous material, microfibrous material, etc., the thickness of the wiping element can even be lower than 500 $\mu$m, such as lower than 300 $\mu$m, for example lower than 200 $\mu$m, while the degree of compression can be different as those specified. Possibly the wiping element can be the combination of a compressible material with a substantially non compressible material or layer, the latter being intended to contact the central strip to be cleaned.

The sealing film 201 is provided on its face 201A with an adhesive layer 204 following substantially the edge of the film. Said adhesive layer 204 is before application of the sealing film on the surface to be sealed, provided with a removable siliconized paper 205, which is removed before gluing the film 201 on the surface to be sealed.

The adhesive layer 204 is adapted for ensuring that at least the film portions 206,207 to which the cleaning element WE is welded by the welding lines L1, preferably by the welding lines L1,L2,L3. This is advantageous for ensuring that the film portion in contact with the wiping element is substantially static with respect to the surface S of the toner. This is also advantageous for increasing the adhesion of said portions 206,207 with the surface, whereby preventing any risk of tearing of the wiping element during the tearing operation of the central portion.

A cardboard support 208 is provided with adhering means. Said support is attached to the face 201B of the film, while not covering the wiping element WE. Said cardboard is suitable for facilitating the placement of the sealing film 201 on the surface S to be sealed, after removal of the siliconized paper or protection sheet 205. Said support is removed after the placement of the sealing film 201.

The central portion CS to be torn out has an end portion 51A opposite to the portion 51B attached to the pulling means 203, said end portion 51A having a reducing width.

Figure 45:
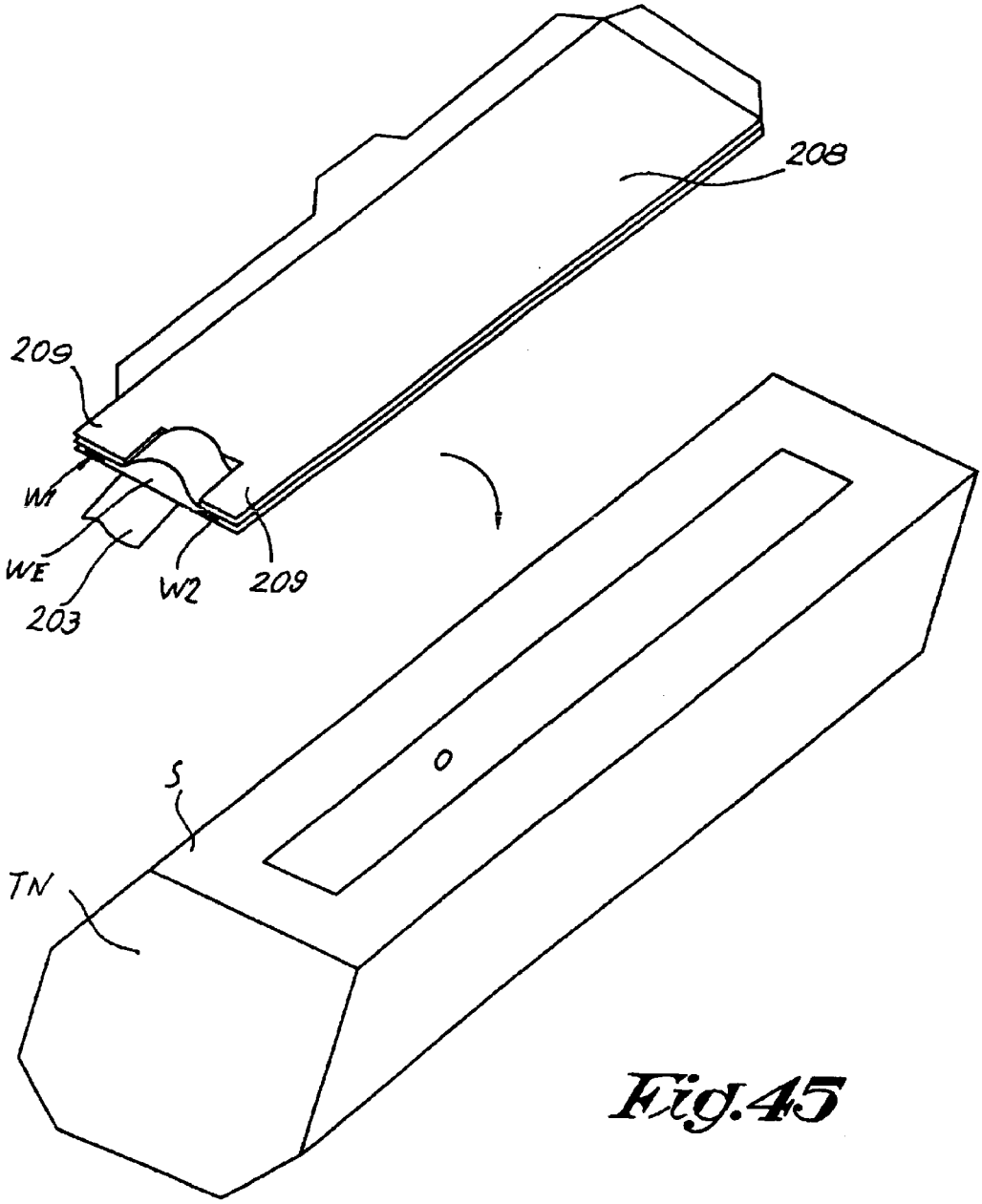
FIG. 45 is a view of an embodiment similar to the sealing member of FIG. 42.

FIG. 45 shows the placement of a sealing film 201 similar to the sealing film 201 of FIG. 42. The sealing film is provided with a removable support 208 (such as in cardboard) having at least a portion supporting or rigidifying a portion of the sealing film 201, and at least portions (such as the arms 209) for supporting or rigidifying the welded portions W1,W2 of the wiping element WE.

Figure 46:
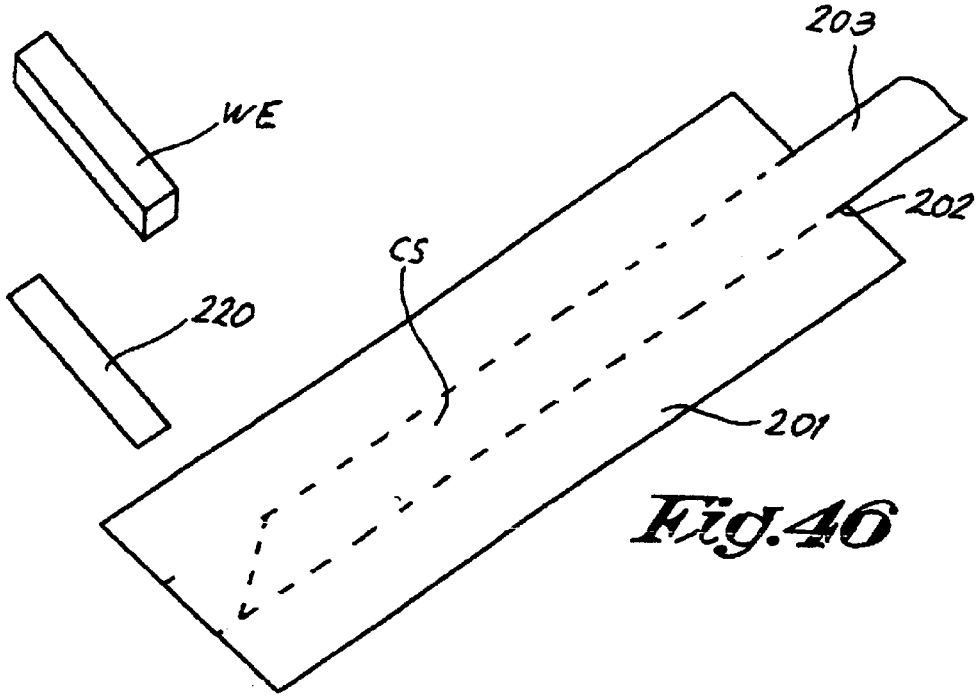
FIG. 46 is an exploded view of a step for the preparation of a sealing member of the type shown in FIG. 42.

In FIG. 46, the sealing film 201 is first associated to an intermediate layer 220 for example made of a material compatible for making a welding between the film 201 and the layer 220 and a welding between the layer 220 and the foam WE, said foam being not compatible as such for welding with the film 201. The foam is for example made in a thermoformable material, i.e. a shape can be given to the foam by heat treatment.

Figure 47:
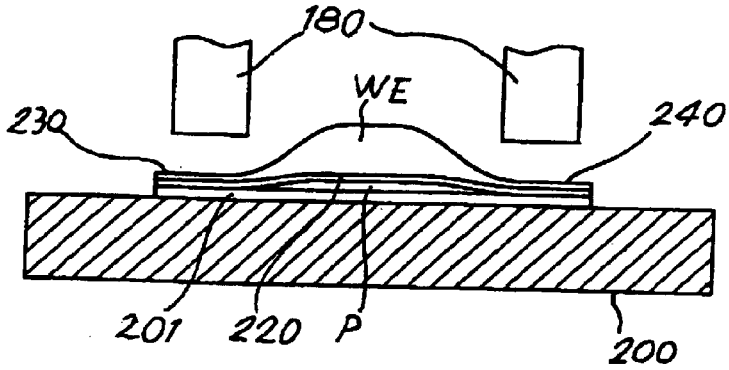
FIG. 47 shows the welding of the components of the sealing member of FIG. 46.

When moving the welding head 180 towards the table 200, the foam edges 230,240 are compressed and heated, whereby said edges are transformed in a sheet shape. A welding is also obtained between the intermediate layer 22 and the film 1 and between the intermediate layer 220 and the sheet shaped edges 230,240 (FIG. 47).

In the embodiment of the preceding figures, the surface cut lines or grooves 7I,7S can be each replaced (partly or completely) by a series of adjacent surface cuts or grooves or recesses spaced from each other with a distance of less than 2 mm, such as less than 1 mm, such as 500 $\mu$m, 250 $\mu$m, 125 $\mu$m (for example with a distance lower to or equal to the thickness of the film).

The embodiment of the preceding figures can be provided with surface cut lines 7I,7S having a variable depth D, for example a depth varying between 10 and 95% of the thickness of the film.

If required, the lateral edges 67,68 of the pulling means 6 can be reinforced, for example by means of a heating step, such as a welding step or a burning step. This enables to give more rigidity to the pulling means, whereby avoiding any risk that the pulling means does not remain in correct place in the toner cartridge due to movement, such as its transport.

For simplifying the placement of a seal of the invention, the sealing member as disclosed in the drawings can be provided with a support means, such as a cardboard support means.

We claim:

1. Sealing member for toner cartridge comprising a sealing film, said film having a substantially longitudinal portion to be torn out between a first end and a second end, said substantially longitudinal portion having a central portion between said first end and second end, said central portion having a substantially constant width defined between two substantially parallel linear grooves and having a substantially longitudinal central axis parallel to said two linear grooves, whereby a portion of said substantially longitudinal portion adjacent t the first end is connected to a pulling means, and whereby at least an end portion of the substantially longitudinal portion to be torn adjacent to one end selected from the first end and the second end is defined at least by a groove having a linear part forming an angle comprised between 5° and 85° with respect to the longitudinal central axis so that said en portion has a width which varies from the substantially constant width of the central portion to an end width lower to the substantially constant width of the substantially longitudinal portion, whereby said linear part of the end portion is connected to one of the substantially parallel linear grooves by a curved groove.

2. The sealing member of claim 1, in which the end width of said end portion is lower to 0.8 time the substantially constant width of the substantially longitudinal portion.

3. The sealing member of claim 1, in which the first end portion and the second end portion have a variable width which continuously varies from the substantially constant width of the central portion to an end width lower to the substantially constant width of the substantially longitudinal portion.

4. The sealing member of claim 1, in which the second end of the longitudinal portion of the film to be torn has a variable width which continuously varies from the substantially constant width of the central portion to an end width lower to the substantially constant width of the substantially longitudinal portion, while the first end is provided with a means for lowering the initial tearing force.

5. The sealing member of claim 1, whereby the sealing film is provided with a surface element selected from the group consisting of recesses, grooves and combinations thereof, said surface element defining the edge of the second end of the longitudinal portion to be torn, whereby said surface element is provided with at least one extension extending in a portion of the film not intended to be torn out.

6. The sealing member of claim 1, in which the film is provided with means for controlling the tearing of the substantially longitudinal portion out of the film.

7. The sealing member of claim 1, in which the film is provided with tearing control means selected from the group consisting of grooves, partial cuts, recesses, openings and combinations thereof at least at an end portion having a width which varies from the substantially constant width of the central portion to an end width lower to the substantially constant width of the substantially longitudinal portion.

8. The sealing member of claim 1, in which a substantially continuous groove defines in the film the substantially longitudinal portion to be torn off.

9. The sealing member of claim 1, in which the central portion of the longitudinal portion of the film to be torn is defined between two substantially parallel grooves, and in which at least a groove defines end portion having a width which varies from the substantially constant width of the central portion to an end width lower to the substantially constant width of the substantially longitudinal portion, whereby at least a linear part of the groove of said end portion forms an angle comprised between 15° an 75° with respect to the pulling direction.

10. The sealing member of claim 1, in which an end portion of the longitudinal portion of the film to be torn has at least partly a curved shape.

11. The sealing member of claim 1, in which an end portion of the longitudinal portion of the film to be torn has a substantially hemi circular shape.

12. The sealing member of claim 1, said member comprising a film with a thickness comprised between 20 $\mu$m and 1 mm.

13. The sealing member of claim 1, whereby said longitudinal portion of the film extending between the first line and the second line is adapted to be torn between the first end and the second end, wherein said sealing film comprises a layer with a thickness comprised between 20$\mu$m and 1 mm and with at least one preferred substantially linear tearing direction, said layer being provided with at least:

a first longitudinal surface element selected from the group consisting of cuts, grooves, recesses and combinations thereof and extending along the first line, and a second longitudinal surface element selected from the group consisting of cuts, grooves, recesses and combinations thereof and extending along the second line, whereby said longitudinal surface elements extend in a direction of at least 5° with respect to the preferred substantially linear tearing direction.

14. The sealing member of claim 13, in which the elements are located on a face of the film intended to be directed towards the toner cartridge.

15. The sealing member of claim 1, whereby said longitudinal portion of the film extending between the first line and the second line is adapted to be torn between the first end and the second end, wherein said sealing film comprises a layer with a thickness comprised between 20 $\mu$m and 1 mm and with at least one preferred substantially linear tearing direction, said layer being provided with at least:

a first longitudinal surface element selected from the group consisting of cuts, grooves, recesses and combinations thereof and extending along the first line, and a second longitudinal surface element selected from the group consisting of cuts, grooves, recesses and combinations thereof and extending along the second line, whereby said longitudinal surface elements extend in a direction of at least 5° with respect to the preferred substantially linear tearing direction, in which the substantially longitudinal portion to be torn out is associated to a pulling means having a portion intended to extend at least partly over one face of the film before the tearing of said portion, whereby at least the portion of the pulling means adjacent to the first end of the portion to be torn out has a sufficient tearing resistance for preventing a separation between the pulling means and the substantially longitudinal portion to be torn out during at least the tearing of the first end of the substantially longitudinal portion of the film to be torn out.

16. The sealing member of claim 15, in which at least the portion of the pulling means intended to extend at least partly over one face of the film before the tearing of the substantially longitudinal portion of the film has a sufficient tearing resistance for preventing a separation between the pulling means and the first end of the substantially longitudinal portion to be torn out during the tearing of the substantially longitudinal portion of the film to be torn out from its first end up to its second end.

17. The sealing member of claim 1, in which the pulling means is made in a material having a sufficient tearing resistance for preventing a rupture of the pulling means during the tearing of the substantially longitudinal portion from its first end up to its second end.

18. The sealing member of claim 1, in which the film and pulling means are made at least partly from one single flexible sheet material with a thickness of at least 40 $\mu$m.

19. The sealing member of claim 1, in which the film and pulling means are made at least partly from one single flexible sheet material with a thickness of at least 100 $\mu$m.

20. The sealing member of claim 1, in which the film and pulling means are made at least partly from one single flexible sheet material with a thickness of at least 200 $\mu$m.

21. The sealing member of claim 1, in which the film is provided with longitudinal surface elements which are associated with a means for lowering the initial tearing force.

22. The sealing member of claim 1, whereby said longitudinal portion of the sealing film extends between the first line and the second line is adapted to be torn between the first end and the second end, wherein said sealing film comprises a layer with a thickness comprised between 20 $\mu$m and 1 mm and with at least one preferred substantially linear tearing direction, said layer being provided with at least:

a first longitudinal surface element selected from the group consisting of cuts, grooves, recesses and combinations thereof and extending along the first line, and a second longitudinal surface element selected from the group consisting of cuts, grooves, recesses and combinations thereof and extending along the second line, whereby said longitudinal surface elements extend in a direction of at least 5° with respect to the preferred substantially linear tearing direction, in which the elements are located on a face of the film not intended to be directed towards the toner cartridge.

23. The sealing member of claim 1, whereby said longitudinal portion of the sealing film extends between the first line and the second line is adapted to be torn between the first end and the second end, wherein said sealing film comprises a layer with a thickness comprised between 20 $\mu$m and 1 mm and with at least one preferred substantially linear tearing direction, said layer being provided with at least:

a first longitudinal surface element selected from the group consisting of cuts, grooves, recesses and combinations thereof and extending along the first line, and a second longitudinal surface element selected from the group consisting of cuts, grooves, recesses and combinations thereof and extending along the second line, whereby said longitudinal surface elements extend in a direction of at least 5° with respect to the preferred substantially linear tearing direction, in which said longitudinal surface elements form an angle comprised between 5 and 175° with respect to the preferred substantially linear tearing direction and extend only partially into the thickness of the layer so as not to transverse the layer.

24. The sealing member of claim 1, whereby said longitudinal portion of the sealing film extend between the first line and the second line is adapted to be torn between the first end and the second end, wherein said sealing film comprises a layer with a thickness comprised between 20 $\mu$m and 1 mm and with at least one preferred substantially linear tearing direction, said layer being provided with at least:

a first longitudinal surface element selected from the group consisting of cuts, grooves, recesses and combinations thereof and extending along the first line, and a second longitudinal surface element selected from the group consisting of cuts, grooves, recesses and combinations thereof and extending along the second line, whereby said longitudinal surface elements extend in a direction of at least 5° with respect to the preferred substantially linear tearing direction, in which the longitudinal surface elements form an angle between 45° and 135° with respect to the preferred substantially linear direction.

25. The sealing member of claim 1, whereby said longitudinal portion of the sealing film extends between the first line and the second line is adapted to be torn between the first end and the second end, wherein said sealing film comprises a layer with a thickness comprised between 20 $\mu$m and 1 mm and with at least one preferred substantially linear tearing direction, said layer being provided with at least:

a first longitudinal surface element selected from the group consisting of cuts, grooves, recesses and combinations thereof and extending along the first line, and a second longitudinal surface element selected from the group consisting of cuts, grooves, recesses and combinations thereof and extending along the second line, whereby said longitudinal surface elements extend in a direction of at least 5° with respect to the preferred substantially linear tearing direction, in which the longitudinal surface elements form an angle of about 90° with respect to the preferred substantially linear direction.

26. The sealing member of claim 1, which comprises a film having a substantially longitudinal portion to be torn out between the first end and the second end, said, longitudinal portion extending between the first line and the second line is adapted to be torn between a first end and a second end, wherein said sealing film comprises a layer with a thickness comprised between 20$\mu$m and 1 mm and with at least one preferred substantially linear tearing direction, said layer being provided with at least:

a first longitudinal surface element selected from the group consisting of cuts, grooves, recesses and combinations thereof and extending along the first line, and a second longitudinal surface element selected from the group consisting of cuts, grooves, recesses and combinations thereof and extending along the second line, whereby said longitudinal surface elements extend in a direction of at least 5° with respect to the preferred substantially linear tearing direction, in which the substantially longitudinal portion to be torn out is associated to the pulling means having a portion intended to be bent so that the pulling means extends at least partly over one face of the film before the tearing of said portion, in which at least one connecting means links the substantially longitudinal portion to be torn out with the pulling means, whereby said connecting means has a sufficient tearing resistance for preventing a separation between the pulling means and the substantially longitudinal portion to be torn out during at least the tearing of the first end of the substantially longitudinal portion of the film to be torn out.

27. The sealing member of claim 26, in which at least one connecting means links the substantially longitudinal portion to be torn out with the pulling means, whereby said connecting means has a sufficient tearing resistance for preventing a separation between the pulling means and the substantially longitudinal portion to be torn out during the tearing of the substantially longitudinal portion from its first end up to its second end.

28. The sealing member of claim 27, in which said connecting means is selected from the group consisting of welding means, gluing means, clipping means, and mixtures thereof.

29. The sealing member of claim 1, in which the pulling means is made in a material having a sufficient tearing resistance for preventing rupture of the pulling means during the tearing of the substantially longitudinal portion from its first end up to its second end.

30. The sealing member of claim 1, in which at least one connecting means links the substantially longitudinal portion to be torn out with the pulling means, whereby the connecting means is a means increasing the tearing resistance of the pulling means at least for a portion of the pulling means adjacent to the first end of the substantially longitudinal portion to be torn out.

31. The sealing member of claim 30, in which the connecting means is a means increasing the tearing resistance of the pulling means at least for a portion of the pulling means adjacent to the first end of the substantially longitudinal portion to be torn out, as well as the first end of the substantially longitudinal portion to be torn out.

32. The sealing member of claim 1, in which at least one connecting means links the substantially longitudinal portion to be torn out with the pulling means and in which the connecting means is selected from the group consisting of flexible tapes, longitudinal welding lines, flexible layers attached to the layer with preferred substantially linear tearing direction, and mixtures thereof.

33. The sealing member of claim 1, which is provided with gluing means for attaching the sealing member on a face of the toner holder or closing its opening.

34. The sealing member of claim 1, which is provided with removable means for facilitating the placement of the sealing member on a face of the toner holder for closing its opening.

35. The sealing member of claim 1, which comprises a foamed insert.

36. The sealing member of claim 1, which comprises a cleaning means for at least wiping the substantially longitudinal portion of the film to be torn during at least a part of its tearing out of the film.

37. The sealing member of claim 1, in which the film comprises at least two lateral portions between which extends the substantially longitudinal portion to be torn out of the film, whereby after the tearing of the central portion out of the film, an opening is formed between at least said two lateral portions.

38. The sealing member of claim 1, in which at least an end portion of the substantially longitudinal portion to be torn adjacent to one end selected from the first end and the second end has a width which continuously varies from the substantially constant width of the central portion to an end width lower to the substantially constant width of the substantially longitudinal portion.

39. Sealing member for toner cartridge comprising a sealing film, said film having a substantially longitudinal portion to be torn out between a first end and a second end, said substantially longitudinal portion having a central portion between said first end and second end, said central portion having a substantially constant width and a substantially longitudinal central axis, whereby a portion of said substantially longitudinal portion adjacent to the first end is connected to a pulling means, and whereby at least an end portion of the substantially longitudinal portion to be torn adjacent to one end selected from the first end and the second end has a width which varies from the substantially constant width of the central portion to an end width lower to the substantially constant width of the substantially longitudinal portion, in which the end width of said end portion is lower to 0.5 time the substantially constant width of the substantially longitudinal portion.

40. The sealing member of claim 39, in which at least an end portion of the substantially longitudinal portion to be torn adjacent to one end selected from the first end and the second end has a width which continuously varies from the substantially constant width of the central portion to an end width lower to the substantially constant width of the substantially longitudinal portion.

41. The sealing member of claim 39, in which at least an end portion of the substantially longitudinal portion to be torn adjacent to one end selected from the first end and the second end has a variable width which continuously varies from the substantially constant width of the central portion to an end width lower to the substantially constant width of the substantially longitudinal portion, said end portion having a length of at least 1 mm, said length being measured in the direction of the substantially longitudinal central axis of the central portion.

42. The sealing member of claim 39, in which at least an end portion of the substantially longitudinal portion to be torn adjacent to one end selected from the first end and the second end has a variable width which continuously varies from the substantially constant width of the central portion to an end width lower to the substantially constant width of the substantially longitudinal portion, said end portion having a length of at least 3 mm, said length being measured in the direction of the substantially longitudinal central axis of the central portion.

43. The sealing member of claim 39, in which at least an end portion of the substantially longitudinal portion to be torn adjacent to one end selected from the first end and the second end has a variable width which continuously varies from the substantially constant width of the central portion to an end width lower to the substantially constant width of the substantially longitudinal portion, said end portion having a length of at least 5 mm, said length being measured in the direction of the substantially longitudinal central axis of the central portion.

44. The sealing member of claim 39, in which the central portion of the longitudinal portion of the film to be torn is defined between two substantially parallel grooves, and in which at least a groove defines an end portion having a width which varies from the substantially constant width of the central portion to an end width lower to the substantially constant width of the substantially longitudinal portion, whereby at least a part of the groove of said end portion forms an angle comprised between 5° and 85° with respect to the pulling direction.

45. The sealing member of claim 39, in which the central portion of the longitudinal portion of the film to be torn is defined between two substantially parallel grooves, and in which at least a groove defines an end portion having a width which varies from the substantially constant width of the central portion to an end width lower to the substantially constant width of the substantially longitudinal portion, whereby at least a part of the groove of said end portion forms an angle comprised between 15° and 75° with respect to the pulling direction.

46. The sealing member of claim 39, in which the central portion of the longitudinal portion of the film to be torn is defined between two substantially parallel linear grooves, and in which at least a groove defines an end portion having a width which varies from the substantially constant width of the central portion to an end width lower to the substantially constant width of the substantially longitudinal portion, whereby at least a linear part of the groove of sail end portion forms an angle comprised between 15° and 75° with respect to the pulling direction, whereby said linear part of the end portion is connected to one of the substantially parallel linear grooves by a curved groove.

47. The sealing member of claim 39, in which the film comprises at least two lateral portions between which extends the substantially longitudinal portion to be torn out of the film, whereby after the tearing of the central portion out of the film, an opening is formed between at least said two lateral portions.

48. Sealing member for toner cartridge comprising a sealing film, said film having a substantially longitudinal portion to be torn out between a first end and a second end, said substantially longitudinal having a central portion between said first end and second end, said central portion having a substantially constant width and a substantially longitudinal central axis, whereby a portion of said substantially longitudinal portion adjacent to the first end is connected to a pulling means, and whereby at least an end portion of the substantially longitudinal portion to be torn adjacent to one end selected from the first end and the second end has a width which varies from the substantially constant width of the central portion to an end width lower to the substantially constant width of the substantially longitudinal portion, whereby the sealing film has two longitudinal edges and two transversal edges, in which at least one end selected from the first end and the second end of the substantially longitudinal portion to be torn is does not reach a transversal edge of the sealing film.

49. The sealing member of claim 48, whereby the sealing film has two longitudinal edges and two transversal edges, in which the first end and the second end of the substantially longitudinal portion to be torn do not reach a transversal edge of the sealing film.

50. The sealing member of claim 48, in which the film comprises at least two lateral portions between which extends the substantially longitudinal portion to be torn out of the film, whereby after the tearing of the central portion out of the film, an opening is formed between at least said two lateral portions.

51. A toner holder selected from the group consisting of toner container and toner cartridge, said holder being provided with a sealing member for closing an opening of the toner holder, said sealing member comprising a sealing film having a substantially longitudinal portion to be torn out between a first end and a second end, said substantially longitudinal portion having a central portion between said first end and second end, said central portion having a substantially constant width defined between two substantially parallel linear grooves and having a substantially longitudinal central axis parallel to said two linear grooves, whereby a portion of said substantially longitudinal portion adjacent to the first end is connected to a pulling means, and whereby at least an end portion of the substantially longitudinal portion to be torn adjacent to one end selected from the first end and the second end is defined at least by a groove having a linear part forming an angle comprised between 5° and 85° with respect to the longitudinal central axis so that said end portion has a variable width which varies from the substantially constant width of the central portion to an end width lower to the substantially constant width of the substantially longitudinal portion, whereby said linear part of the end portion is connected to one of the substantially parallel linear grooves by a curved groove.

52. The toner holder of claim 51, in which the end width of the end portion with variable width is lower to 0.8 time the substantially constant width of the substantially longitudinal portion.

53. The toner holder of claim 51, in which for the sealing film the first end and the second end have a variable width which continuously varies from the substantially constant width of the central portion to an end width lower to the substantially constant width of the substantially longitudinal portion.

54. The toner holder of claim 51, in which for the sealing film, the second end has a variable width which continuously varies from the substantially constant width of the central portion to an end width lower to the substantially constant width of the substantially longitudinal portion, while the first end is provided with a means for lowering the initial tearing force.

55. The toner holder of claim 51, in which the film is provided with means for controlling the tearing of the substantially longitudinal portion out of the film.

56. The toner holder of claim 51, the sealing film of which is provided with a surface element selected from the group consisting of recesses, grooves and combinations thereof, said surface element defining the edge of the second end of the longitudinal portion to be torn, whereby said surface element is provided with at least one extension extending in a portion of the film not intended to be torn out.

57. The toner holder of claim 51, in which the film is provided with tearing control means selected from the group consisting of grooves, partial cuts, recesses, openings and combinations thereof at least at an end portion having a width which varies from the substantially constant width of the central portion to an end width lower to the substantially constant width of the substantially longitudinal portion.

58. The toner holder of claim 51, in which for the sealing film, a substantially continuous groove defines in the film the substantially longitudinal portion to be torn off.

59. The toner holder of claim 51, in which for the sealing film the central portion is defined between two substantially parallel grooves, and in which at least a groove defines an end portion having a width which varies from the substantially constant width of the central portion to an end width lower to the substantially constant width of the substantially longitudinal portion, whereby at least a linear part of the groove of said end portion forms an angle comprised between 15° and 75° with respect to the pulling direction.

60. The toner holder of claim 51, in which the end portion of the substantially longitudinal portion to be torn has at least partly a curve shape.

61. The toner holder of claim 60, in which the end portion has a substantially hemi circular shape.

62. The toner holder of claim 51, said film having a thickness comprised between 20 $\mu$m and 1 mm.

63. The toner holder of claim 51, whereby for the sealing film, the longitudinal central portion extending between a first longitudinal line and a second longitudinal line adapted to be torn between the first end and the second end, wherein said sealing film comprises a layer with a thickness comprised between 20 μm and 1 mm and with at least one preferred substantially linear tearing direction, said layer being provided with at least:

a first longitudinal surface element selected from the group consisting of cuts, grooves, recesses and combinations thereof and extending along the first longitudinal line, and a second longitudinal surface element selected from the group consisting of cuts, grooves, recesses and combinations thereof and extending along the second longitudinal line, whereby said first and second longitudinal surface elements extend in a direction of at least 5° with respect to the preferred substantially linear tearing direction.

64. The toner holder of claim 51, whereby for the sealing film, said longitudinal portion extending between the first line and the second line is adapted to be torn between the first end and the second end, wherein said sealing film comprises a layer with a thickness comprised between 20 μm and 1 mm and with at least one preferred substantially linear tearing direction, said layer being provided with at least:

a first longitudinal surface element selected from the group consisting of cuts, grooves, recesses and combinations thereof and extending along the first line, and a second longitudinal surface element selected from the group consisting of cuts, grooves, recesses and combinations thereof and extending along the second line, whereby said longitudinal surface elements extend in a direction of at leas 5° with respect to the preferred substantially linear tearing direction, in which the substantially longitudinal portion to be torn out is associated to a pulling means having a portion intended to extend at least partly over one face of the film before the tearing of said portion, whereby at least the portion of the pulling means adjacent to the first end of the portion to be torn out has a sufficient tearing resistance for preventing a separation between the pulling means and the substantially longitudinal portion to be torn out during at least the tearing of the first end of the substantially longitudinal portion of the film to be torn out.

65. The toner holder of claim 51, in which for the sealing film, at least the portion of the pulling means intended to extend at least partly over one face of the film before the tearing of the substantially longitudinal portion of the film has a sufficient tearing resistance for preventing a separation between the pulling means and the first end of the substantially longitudinal portion to be torn out during the tearing of the substantially longitudinal portion of the film to be torn out from its first end up to its second end.

66. The toner holder of claim 51, in which for the sealing film, the pulling means is made in a material having a sufficient tearing resistance for preventing a rupture of the pulling means during the tearing of the substantially longitudinal portion from its first end up to its second end.

67. The toner holder of claim 51, in which the film and pulling means are made at least partly from one single flexible sheet material with a thickness of at least 40 μm.

68. The toner holder of claim 51, in which the film and pulling means are made at least partly from one single flexible sheet material with a thickness of at least 100 μm.

69. The toner holder of claim 51, in which the film and pulling means are made at least partly from one single flexible sheet material with a thickness of at least 200 μm.

70. The toner holder of claim 51, in which longitudinal surface elements defines in the sealing film the longitudinal portion to be torn out, said surface element being associated with a means for lowering the initial tearing force.

71. The toner holder of claim 70, in which the elements are located on a face of the film intended to be directed towards the toner cartridge.

72. The toner holder of claim 51, whereby for the sealing film, the longitudinal central portion extending between a first longitudinal line and a second longitudinal line is adapted to be torn between the first end and the second end, wherein said sealing film comprises a layer with a thickness comprised between 20 μm and 1 mm and with at least one preferred substantially linear tearing direction, said layer being provided with at least:

a first longitudinal surface element selected from the group consisting of cuts, grooves, recesses and combinations thereof and extending along the first longitudinal line, and a second longitudinal surface element selected from the group consisting of cuts, grooves, recesses and combinations thereof and extending along the second longitudinal line, whereby said first and second longitudinal surface elements extend in a direction of at least 5° with respect to the preferred substantially linear tearing direction, in which the elements are located on a face of the film not intended to be directed towards the toner cartridge.

73. The toner holder of claim 51, whereby for the sealing film, the longitudinal central portion extending between a first longitudinal line and a second longitudinal line is adapted to be torn between the first end and the second end, wherein said sealing film comprises a layer with a thickness comprised between 20 μm and 1 mm and with at least one preferred substantially linear tearing direction, said layer being provided with at least:

a first longitudinal surface element selected from the group consisting of cuts, grooves, recesses and combinations thereof and extending along the first longitudinal line, and a second longitudinal surface element selected from the group consisting of cuts, grooves, recesses and combinations thereof and extending along the second longitudinal line, whereby said first and second longitudinal surface elements extend in a direction of at least 5° with respect to the preferred substantially linear tearing direction, in which said longitudinal surface elements form an angle comprised between 5 and 175° with respect to the preferred substantially linear tearing direction and extend only partially into the thickness of the layer so as not to transverse the layer.

74. The toner holder of claim 51, whereby for the sealing film, the longitudinal central portion extending between a first longitudinal line and a second longitudinal line is adapted to be torn between the first end and the second end, wherein said sealing film comprises a layer with a thickness comprised between 20 μm and 1 mm and with at least one preferred substantially linear tearing direction, said layer being provided with at least:

a first longitudinal surface element selected from the group consisting of cuts, grooves, recesses and combinations thereof and extending along the first longitudinal line, and a second longitudinal surface element selected from the group consisting of cuts, grooves, recesses and combinations thereof and extending along the second longitudinal line, in which the first and second longitudinal surface elements form an angle between 45° and 135° with respect to the preferred substantially linear direction.

75. The toner holder of claim 51, whereby for the sealing film, the longitudinal central portion extending between a first longitudinal line and a second longitudinal line is adapted to be torn between the first end and the second end, wherein said sealing film comprises a layer with a thickness comprised between 20 μm and 1 mm and with at least one preferred substantially linear tearing direction, said layer being provided with at least:

a first longitudinal surface element selected from the group consisting of cuts, grooves, recesses and combinations thereof and extending along the first longitudinal line, and a second longitudinal surface element selected from the group consisting of cuts, grooves, recesses and combinations thereof and extending along the second longitudinal line, in which the first and second longitudinal surface elements form an angle of about 90° with respect to the preferred substantially linear direction.

76. The toner holder of claim 51, in which the film has a substantially longitudinal portion to be torn out between the first end and the second end, said longitudinal portion having a longitudinal central portion extending between a first longitudinal line and a second longitudinal line, wherein said sealing film comprises a layer with a thickness comprised between 20 μm and 1 mm and with at least one preferred substantially linear tearing direction, said layer being provided with at least:

a first longitudinal surface element selected from the group consisting of cuts, grooves, recesses and combinations thereof and extending along the first longitudinal line, and a second longitudinal surface element selected from the group consisting of cuts, grooves, recesses and combinations thereof and extending along the second longitudinal line, whereby said first and second longitudinal surface elements extend in a direction of at least 5° with respect to the preferred substantially linear tearing direction, in which the substantially longitudinal portion to be torn out is associated to a pulling means having a portion intended to be bent so that the pulling means extends at least partly over one face of the film before the tearing of said portion, in which at least one connecting means links the substantially longitudinal portion to be torn out with the pulling means, whereby said connecting means has a sufficient tearing resistance for preventing a separation between the pulling means and the substantially longitudinal portion to be torn out during at least the tearing of the first end of the substantially longitudinal portion of the film to be torn out.

77. The toner holder of claim 51, in which for the sealing film, at least one connecting means links the substantially longitudinal portion to be torn out with the pulling means, whereby said connecting means has a sufficient tearing resistance for preventing a separation between the pulling means and the substantially longitudinal portion to be torn out during the tearing of the substantially longitudinal portion from its first end up to its second end.

78. The toner holder of claim 77, in which said connecting means is selected from the group consisting of welding means, gluing means, clipping means, and mixtures thereof.

79. The toner holder of claim 78, in which the pulling means is made in a material having a sufficient tearing resistance for preventing a rupture of the pulling means during the tearing of the substantially longitudinal portion from its first end up to its second end.

80. The toner holder of claim 51, in which for the sealing film, the pulling means is attached to the longitudinal portion to be torn by a connecting means, whereby the connecting means is a means increasing the tearing resistance of the pulling means at least for a portion of the pulling means adjacent to the first end of the substantially longitudinal portion to be torn out.

81. The toner holder of claim 80, in which for the sealing film, the connecting means is a means increasing the tearing resistance of the pulling means at least for a portion of the pulling means adjacent to the first end of the substantially longitudinal portion to be torn out, as well as the first end of the substantially longitudinal portion to be torn out.

82. The toner holder of claim 80, in which the connecting means is selected from the group consisting of flexible tapes, longitudinal welding lines, flexible layers attached to the layer with preferred substantially linear tearing direction, and mixtures thereof.

83. The toner holder of claim 51, in which the substantially longitudinal portion of the sealing film has a shape adapted for covering at least completely the opening of the toner holder.

84. The toner container of claim 51, in which the film comprises at least two lateral portions between which extends the substantially longitudinal portion to be torn out of the film, whereby after the tearing of the central portion out of the film, an opening is formed between at least said two lateral portions.

85. The toner holder of claim 51, in which at least an end portion of the substantially longitudinal portion to be torn adjacent to one end selected from the first end and the second end has a width which continuously varies from the substantially constant width of the central portion to an end width lower to the substantially constant width of the substantially longitudinal portion.

86. A toner holder selected from the group consisting of toner container and toner cartridge, said holder being provided with a sealing member for closing an opening of the toner holder, said sealing member comprising a sealing film having a substantially longitudinal portion to be torn out between a first end and a second end, said substantially longitudinal having a central portion between said first end and second end, said central portion having a substantially constant width and a substantially longitudinal central axis, whereby a portion of said substantially longitudinal portion adjacent to the first end is connected to a pulling means, and whereby at least an end portion of the substantially longitudinal portion to be torn adjacent to one end selected from the first end and the second end has a variable width which varies from the substantially constant width of the central portion to an end width lower to the substantially constant width of the substantially longitudinal portion, in which the end width of the end portion with variable width is lower to 0.5 time the substantially constant width of the substantially longitudinal portion.

87. The toner holder of claim 86, in which at least an end portion of the substantially longitudinal portion to be torn adjacent to one end selected from the first end and the second end has a width which continuously varies from the substantially constant width of the central portion to end width lower to the substantially constant width of the substantially longitudinal portion.

88. The toner holder of claim 86, in which for the sealing film, at least an end portion of the substantially longitudinal portion to be torn adjacent to one end selected from the first end and the second end has a variable width which continuously varies from the substantially constant width of the central portion to an end width lower to the substantially constant width of the substantially longitudinal portion, said end portion having a length of at least 1 mm, said length being measured in the direction of the substantially longitudinal central axis of the central portion.

89. The toner holder of claim 86, in which for the sealing film, at least an end portion of the substantially longitudinal portion to be torn adjacent to one end selected from the first end and the second end has a variable width which continuously varies from the substantially constant width of the central portion to an end width lower to the substantially constant width of the substantially longitudinal portion, said end portion having a length of at least 3 mm, said length being measured in the direction of the substantially longitudinal central axis of the central portion.

90. The toner holder of claim 86, in which for the sealing film, at least an end portion of the substantially longitudinal portion to be torn adjacent to one end selected from the first end and the second end has a variable width which continuously varies from the substantially constant width of the central portion to an end width lower to the substantially constant width of the substantially longitudinal portion, said end portion having a length of at least 5 mm, said length being measured in the direction of the substantially longitudinal central axis of the central portion.

91. The toner holder of claim 86, in which for the sealing film, the central portion is defined between two substantially parallel grooves, and in which at least a groove defines an end portion having a width which varies from the substantially constant width of the central portion to end width lower to the substantially constant width of the substantially longitudinal portion, whereby at least a part of the groove of said end portion forms an angle between 5° and 85° with respect to the pulling direction.

92. The toner holder of claim 86, in which for the sealing film, the central portion is defined between two substantially parallel grooves, and in which at least a groove defines an end portion having a width which varies from the substantially constant width of the central portion to end width lower to the substantially constant width of the substantially longitudinal portion, whereby at least a part of the groove of said end portion forms an angle comprised between 15° and 75° with respect to the pulling direction.

93. The toner holder of claim 86, in which for the sealing film, the central portion is defined between two substantially parallel linear grooves, and in which at least a groove defines an end portion having width which varies from the substantially constant width of the central portion to an end width lower to the substantially constant width of the substantially longitudinal portion, whereby at least a linear part of the groove of said end portion forms an angle comprised between 15° and 75° with respect to the pulling direction, whereby said linear part of the end portion is connected to one of the substantially parallel linear grooves by a curved groove.

94. The toner container of claim 86, in which the film comprises at least two lateral portions between which extends the substantially longitudinal portion to be torn out of the film, whereby after the tearing of the central portion out of the film, an opening is formed between at least said two lateral portions.

95. A toner holder selected from the group consisting of toner container and toner cartridge, said holder being provided with a sealing member for closing an opening of the toner holder, said sealing member comprising a sealing film having a substantially longitudinal portion to be torn out between a first end and a second end, said substantially longitudinal having a central portion between said first end and second end, said central portion having a substantially constant width and a substantially longitudinal central axis, whereby a portion of said substantially longitudinal portion adjacent to the first end is connected to a pulling means, and whereby at least an end portion of the substantially longitudinal portion to be torn adjacent to one end selected from the first end and the second end has a variable width which varies from the substantially constant width of the central portion to an end width lower to the substantially constant width of the substantially longitudinal portion, whereby the sealing film has two longitudinal edges and two transversal edges, in which at least one end selected from the first end and the second end of the substantially longitudinal portion to be torn is does not reach a transversal edge of the sealing film.

96. The toner holder of claim 95, whereby the sealing film has two longitudinal edges and two transversal edges, in which the first end and the second end of the substantially longitudinal portion to be torn do not reach a transversal edge of the sealing film.

97. The toner container of claim 95, which the film comprises at least two lateral portions between which extends the substantially longitudinal portion to be torn out of the film, whereby after the tearing of the central portion out of the film, an opening is formed between at least said two lateral portions.

98. Sealing member for toner cartridge comprising a sealing film, said film having a substantially longitudinal portion to be torn out of the film between a first and a second end, said substantially longitudinal portion having a central portion between said first end and second end, said central portion having a substantially constant width and a substantially longitudinal central axis, in which the film comprises at least two lateral portions between which extends the substantially longitudinal portion to be torn out of the film, whereby after the tearing of the central portion out of the film, an opening is formed between at least said two lateral portions, whereby a portion of said substantially longitudinal portion adjacent to the first end is connected to a pulling means, and whereby at least an end portion of the substantially longitudinal portion to be torn adjacent to one end selected from the first and the second end has a width which varies from the substantially constant width of the central portion to an end width lower to the substantially constant width of the substantially longitudinal portion, in which the end width of said end portion is lower than 2 mm.

99. The sealing member of claim 98, in which the end width of said end portion is equal to about 0 mm.

100. A toner holder selected from the group consisting of toner container and toner cartridge, said holder being provided with a sealing member for closing an opening of the toner holder, said sealing member comprising a sealing film having a substantially longitudinal portion to be torn out between a first and a second end, said substantially longitudinal portion having a central portion between said first end and second end, said central portion having a substantially constant width and a substantially longitudinal central axis in which the film comprises at least two lateral portions between which extends the substantially longitudinal portion to be torn out of the film, whereby after the tearing of the central portion out of the film, an opening is formed between at least said two lateral portions, whereby a portion of said substantially longitudinal portion adjacent to the first end is connected to a pulling means, and whereby at least an end portion of the substantially longitudinal portion to be torn adjacent to one end selected from the first and the second end has a width which varies from the substantially constant width of the central portion to an end width lower to the substantially constant width of the substantially longitudinal portion, in which the end width of said end portion is lower than 2 mm.

101. The toner holder of claim 100, in which the end width of said end portion is equal to about 0 mm.

102. Sealing member for toner cartridge comprising a sealing film, said film having a substantially longitudinal portion to be torn out between a first end and a second end, said substantially longitudinal having a central portion between said first end and second end, said central portion having a substantially constant width and a substantially longitudinal central axis, whereby a portion of said substantially longitudinal portion adjacent to the first end is connected to a pulling means, and whereby at least an end portion of the substantially longitudinal portion to be torn adjacent to one end selected from the first end and the second end has a width which varies from the substantially constant width of the central portion to an end width lower to the substantially constant width of the substantially longitudinal portion, whereby the sealing film has two longitudinal edges and two transversal edges, in which the first end and the second end of the substantially longitudinal portion to be torn do not reach a transversal edge of the sealing film.

103. Sealing member for toner cartridge comprising a sealing film, said film having a substantially longitudinal portion to be torn out between a first end and a second end, said substantially longitudinal having a central portion between sad first end and second end, said central portion having a substantially constant width and a substantially longitudinal central axis, whereby a portion of said substantially longitudinal portion adjacent to the first end is connected to a pulling means, and whereby at least an end portion of the substantially longitudinal portion to be torn adjacent to one end selected from the first end and the second end has a width which varies from the substantially constant width of the central portion to an end width lower to the substantially constant width of the substantially longitudinal portion, in which at least an end portion of the substantially longitudinal portion to be torn adjacent to one end selected from the first end and the second end has a variable width which continuously varies from the substantially constant width of the central portion to an end width lower to the substantially constant width of the substantially longitudinal portion, said end portion having a length of at least 1 mm, said length being measured in the direction of the substantially longitudinal central axis of the central portion.

104. Sealing member for toner cartridge comprising a sealing film, said film having a substantially longitudinal portion to be torn out between a first end and a second end, said substantially longitudinal having a central portion between said first end and second end, said central portion having a substantially constant width and a substantially longitudinal central axis, whereby a portion of said substantially longitudinal portion adjacent to the first end is connected to a pulling means, and whereby at least an end portion of the substantially longitudinal portion to be torn adjacent to one end selected from the first end and the second end has a width which varies from the substantially constant width of the central portion to an end width lower to the substantially constant width of the substantially longitudinal portion, in which at least an end portion of the substantially longitudinal portion to be torn adjacent to one end selected from the first end and the second end has a variable width which continuously varies from the substantially constant width of the central portion to an end width lower to the substantially constant width of the substantially longitudinal portion, said end portion having a length of at least 3 mm, said length being measured in the direction of the substantially longitudinal central axis of the central portion.

105. Sealing member for toner cartridge comprising a sealing film, said film having a substantially longitudinal portion to be torn out between a first end and a second end, said substantially longitudinal having a central portion between said first end and second end, said central portion having a substantially constant width and a substantially longitudinal central axis, whereby a portion of said substantially longitudinal portion adjacent to the first end is connected to a pulling means, and whereby at least an end portion of the substantially longitudinal portion to be torn adjacent to one end selected from the first end and the second end has a width which varies from the substantially constant width of the central portion to an end width lower to the substantially constant width of the substantially longitudinal portion, in which at least an end portion of the substantially longitudinal portion to be torn adjacent to one end selected from the first end and the second end has a variable width which continuously varies from the substantially constant width of the central portion to an end width lower to the substantially constant width of the substantially longitudinal portion, said end portion having length of at least 5 mm, said length being measured in the direction of the substantially longitudinal central axis of the central portion.

106. Sealing member for toner cartridge comprising a sealing film, said film having a substantially longitudinal portion to be torn out between a first end and a second end according to a pulling direction, said substantially longitudinal portion having a central portion between said first end and second end, said central portion having a substantially constant width defined between two substantially parallel grooves and having a substantially longitudinal axis, whereby a portion of said longitudinal portion adjacent to the first end is connected to a pulling means, and whereby at least an end portion of the substantially longitudinal portion to be torn adjacent to one end selected from the first end and the second end has a width which varies from the substantially constant width of the central portion to an end width lower to the substantially constant width of the substantially longitudinal portion, whereby at least a groove defines an end portion having a width which varies from the substantially constant width of the central portion to an end width lower to the substantially constant width of the substantially longitudinal portion, whereby at least a part of the groove of said end portion forms an angle comprised between 5° and 85° with respect to the pulling direction.

107. Sealing member for toner cartridge comprising a sealing film, said film having a substantially longitudinal portion to be torn out between a first end and a second end according to a pulling direction, said substantially longitudinal portion having a central portion between said first end and second end, said central portion having a substantially constant width defined between two substantially parallel grooves and having a substantially longitudinal central axis, whereby a portion of said substantially longitudinal portion adjacent to the first end is connected to a pulling means, and whereby at least an end portion of the substantially longitudinal portion to be torn adjacent to one end selected from the first end and the second end has a width which varies from the substantially constant width of the central portion to an end width lower to the substantially constant width of the substantially longitudinal portion, whereby at least a groove defines an end portion having a width which varies from the substantially constant width of the central portion to an end width lower to the substantially constant width of the substantially longitudinal portion, whereby at least a part of the groove of said end portion forms an angle comprised between 15° and 75° with respect to the pulling direction.

108. A toner holder selected from the group consisting of toner container and toner cartridge, said holder being provided with sealing member for closing an opening of the toner holder, said sealing member comprising a sealing film having a substantially longitudinal portion to be torn out between a first end and a second end, said substantially longitudinal having a central portion between said first end and second end, said central portion having a substantially constant width and a substantially longitudinal central axis, whereby a portion of said substantially longitudinal portion adjacent to the first end is connected to a pulling means, and whereby at least an end portion of the substantially longitudinal portion to be torn adjacent to one end selected from the first end and the second end has a variable width which varies from the substantially constant width of the central portion to an end width lower to the substantially constant width of the substantially longitudinal portion, in which for the sealing film, at least an end portion of the substantially longitudinal portion to be torn adjacent to one end selected from the first end and the second end has a variable width which continuously varies from the substantially constant width of the central portion to an end width lower to the substantially constant width of the substantially longitudinal portion, said end portion having a length of at least 1 mm, said length being measured in the direction of the substantially longitudinal axis of the central portion.

109. A toner holder selected from the group consisting of toner container and toner cartridge, said holder being provided with sealing member for closing an opening of the toner holder, said sealing member comprising a sealing film having a substantially longitudinal portion to be torn out between a first end and a second end, said substantially longitudinal having a central portion between said first end and second end, said central portion having a substantially constant width and a substantially longitudinal central axis, whereby a portion of said substantially longitudinal portion adjacent to the first end is connected to a pulling means, and whereby at least an end portion of the substantially longitudinal portion to be torn adjacent to one end selected from the first end and the second end has a variable width which varies from the substantially constant width of the central portion to an end width lower to the substantially constant width of the substantially longitudinal portion, in which for the sealing film, at least an end portion of the substantially longitudinal portion to be torn adjacent to one end selected from the first end and the second end has a variable width which continuously varies from the substantially constant width of the central portion to a end width lower to the substantially constant width of the substantially longitudinal portion, said end portion having a length of at least 3 mm, said length being measured in the direction of the substantially longitudinal central axis of the central portion.

110. A toner holder selected from the group consisting of toner container and toner cartridge, said holder being provided with a sealing member for closing an opening of the toner holder, said sealing member comprising a sealing film having a substantially longitudinal portion to be torn out between a first end and a second end, said substantially longitudinal having a central portion between said first end and second end, said central portion having a substantially constant width and a substantially longitudinal central axis, whereby a portion of said substantially longitudinal portion adjacent to the first end is connected to a pulling means, and whereby at least an end portion of the substantially longitudinal portion to be torn adjacent to one end selected from the first end and the second end has a variable width which varies from the substantially constant width of the central portion to an end width lower to the substantially constant width of the substantially longitudinal portion, in which for the sealing film, at least an end portion of the substantially longitudinal portion to be torn adjacent to one end selected from the first end and the second end has a variable width which continuously varies from the substantially constant width of the central portion to an end width lower to the substantially constant width of the substantially longitudinal portion, said end portion having a length of at least 5 mm, said length being measured in the direction of the substantially longitudinal central axis of the central portion.

111. A toner holder selected from the group consisting of toner container and toner cartridge, said holder being provided with a sealing member for closing an opening of the toner holder, said sealing member comprising a sealing film having a substantially longitudinal portion to be torn out between a first end and a second end in a pulling direction, said substantially longitudinal portion having a central portion between said first end and second end, said central portion having a substantially constant width defined between two substantially parallel linear grooves and having a substantially longitudinal central axis, whereby a portion of said substantially longitudinal portion adjacent to the first end is connected to a pulling means, and whereby at least an end portion of the substantially longitudinal portion to be torn adjacent to one end selected from the first end and the second end has a variable width which varies from the substantially constant width of the central portion to an end width lower to the substantially constant width of the substantially longitudinal portion, whereby at least a groove defines an end portion having a width which varies from the substantially constant width of the central portion to an end width lower to the substantially constant width of the substantially longitudinal portion, whereby at least a part of the groove of said end portion forms an angle between 5° and 85° with respect to the pulling direction.

112. A toner holder selected from the group consisting of toner container and toner cartridge, said holder being provided with a sealing member for closing an opening of the toner holder, said sealing member comprising a sealing film having a substantially longitudinal portion to be torn out between a first end and a second end in a pulling direction, said substantially longitudinal portion having a central portion between said first end and second end, said central portion having a substantially constant width defined between two substantially parallel linear grooves and having a substantially longitudinal central axis, whereby a portion of said substantially longitudinal portion adjacent to the first end is connected to a pulling means, and whereby at least an end portion of the substantially longitudinal portion to be torn adjacent to one end selected from the first end and the second end has a variable width which varies from the substantially constant width of the central portion to an end width lower to the substantially constant width of the substantially longitudinal portion, whereby at least a groove defines an end portion having a width which varies from the substantially constant width of the central portion to an end width lower to the substantially constant width of the substantially longitudinal portion, whereby at least a part of the groove of said end portion forms an angle between 5° and 85° between 15° and 75° with respect to the pulling direction.

* * * * *